US007513759B1

(12) United States Patent
Blume

(10) Patent No.: US 7,513,759 B1
(45) Date of Patent: Apr. 7, 2009

(54) VALVE GUIDE AND SPRING RETAINER ASSEMBLIES

(76) Inventor: George H. Blume, 107 Morning Cloud Cove, Austin, TX (US) 78734

( * ) Notice: Subject to any disclaimer, the term of this patent is extended or adjusted under 35 U.S.C. 154(b) by 676 days.

(21) Appl. No.: 11/125,282

(22) Filed: May 9, 2005

Related U.S. Application Data

(63) Continuation-in-part of application No. 10/613,295, filed on Jul. 3, 2003, now Pat. No. 6,910,871.

(51) Int. Cl.
*F04B 53/10* (2006.01)

(52) U.S. Cl. ..... 417/568; 417/454; 137/512

(58) Field of Classification Search ..... 417/567–569, 417/571, 454, 415; 137/454.4, 512
See application file for complete search history.

(56) References Cited

U.S. PATENT DOCUMENTS 2,257,417 A * 9/1941 Kelley ..... 123/193.3
4,084,606 A * 4/1978 Mittleman ..... 137/102
4,508,133 A * 4/1985 Hamid ..... 137/68.22
4,771,801 A * 9/1988 Crump et al. ..... 137/68.26
6,264,441 B1 * 7/2001 Marioni ..... 417/423.1
2002/0096217 A1 * 7/2002 Wu et al. ..... 137/543.19

* cited by examiner

*Primary Examiner*—Devon C Kramer
*Assistant Examiner*—Dnyanesh Kasture
(74) *Attorney, Agent, or Firm*—Dennis W. Gilstad

(57) ABSTRACT

Tapered valve guide and spring retainer assemblies are described for use in plunger pump housings that incorporate corresponding outwardly flared discharge and suction bores, as well as structural features for stress-relief. Plunger pumps so constructed are relatively resistant to fatigue failure because of stress reductions, and they may incorporate a variety of valve styles, including top and lower stem-guided valves and crow-foot-guided valves, in easily-maintained configurations. Besides forming a part of valve guide and spring retainer assemblies, side spacers may be shaped and dimensioned to improve volumetric efficiency of the pumps in which they are used.

6 Claims, 22 Drawing Sheets

Typical Fluid Section

Triplex Fluid Section Housing

Conventional Plunger Pump Housing

Y-Block Plunger Pump Housing

Y-Block Fluid Section

Right Angular Plunger Pump Fuid Section (Section B-B of Figure 7A)

(Section C-C of Figure 7A)

(Section D-D of Figure 7A)

(Section E-E of Figure 7A)

(Section B-B of Figure 11A)

(Section C-C of Figure 11A)

(Section B-B of Figure 12A)

(Section C-C of Figure 12A)

(Bottom View of Figure 12A)

(Section B-B of Figure 13A)

(Section C-C of Figure 13A)

(Bottom View of Figure 13A)

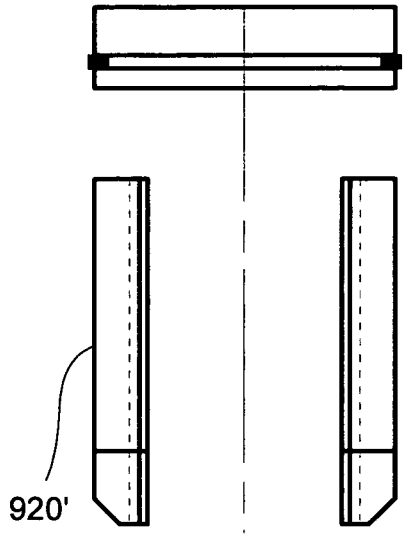
Figure 14C
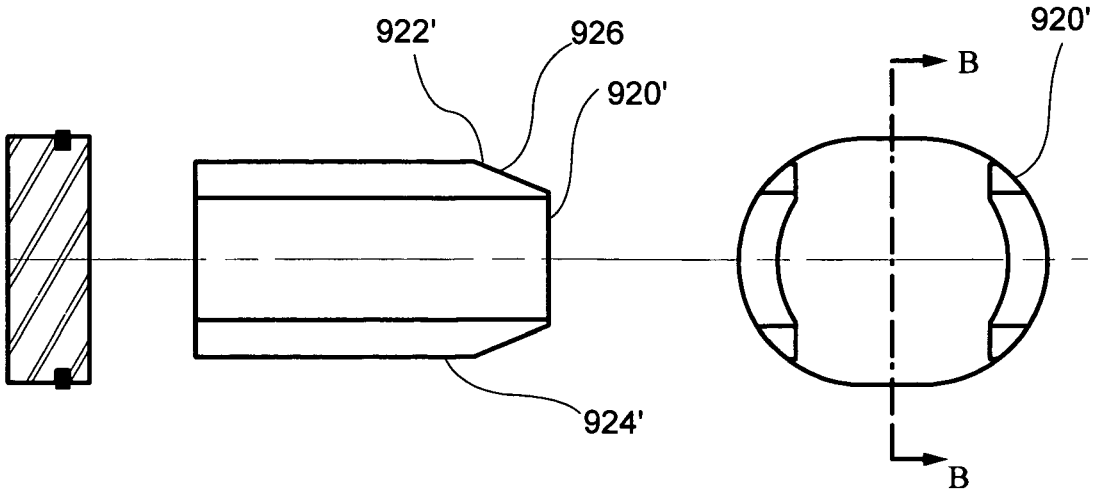
(Section B-B of Figure 14A)
Figure 14B
Figure 14A (Section B-B of Figure 15A)

(Section B-B of Figure 16A)

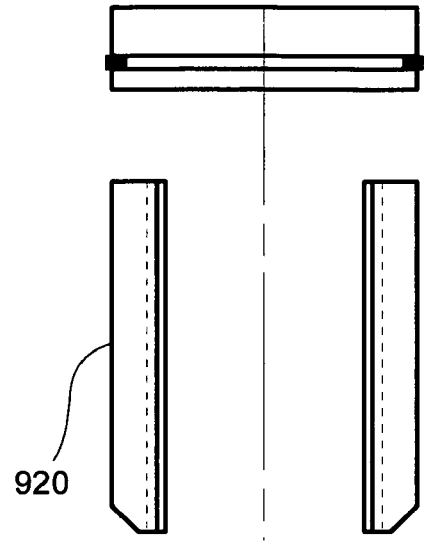
Figure 17C
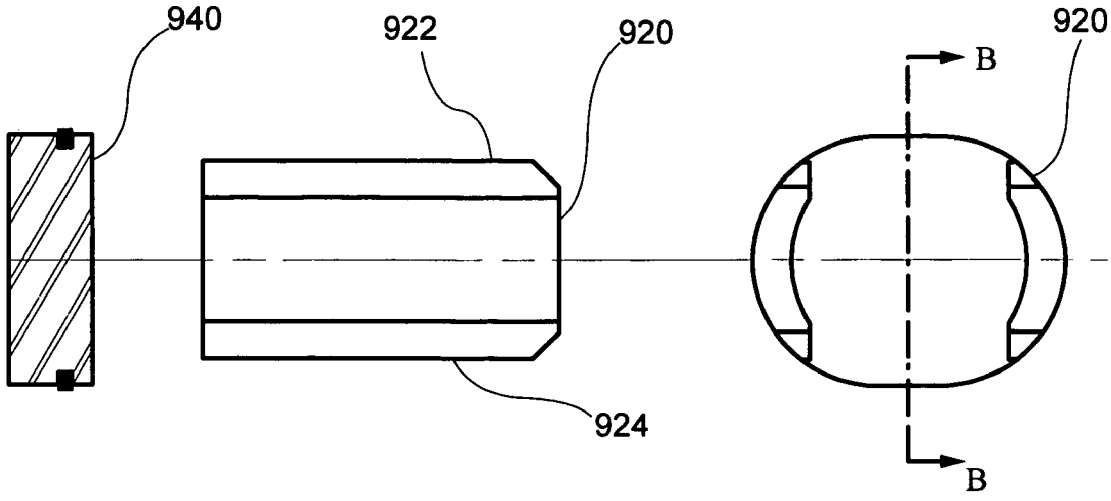
(Section B-B of Figure 17A)
Figure 17B
Figure 17A

VALVE GUIDE AND SPRING RETAINER ASSEMBLIES

This is a continuation-in-part (CIP) of U.S. patent application Ser. No. 10/613,295 filed Jul. 3, 2003 now U.S. Pat. No. 6,910,871 (hereinafter the '295 application).

FIELD OF THE INVENTION

The invention relates generally to high-pressure plunger pumps used, for example, in oil field operations. More particularly, the invention relates to valve guides and spring retainers for use in plunger pump housings that incorporate structural features for stress-relief and for accommodating valve guide and/or spring retainer assemblies.

BACKGROUND

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. Commonly used fluid sections usually comprise a plunger pump housing having a suction valve in a suction bore, a discharge valve in a discharge bore, an access bore, and a plunger in a plunger bore, plus high-pressure seals, retainers, etc. FIG. 1 is a cross-sectional schematic view of a typical fluid section showing its connection to a power section by stay rods. A plurality of fluid sections similar to that illustrated in FIG. 1 may be combined, as suggested in the Triplex fluid section housing schematically illustrated in FIG. 2.

Valve terminology varies according to the industry (e.g., pipeline or oil field service) in which the valve is used. In some applications, the term "valve" means just the moving element or valve body. In the present application, however, the term "valve" includes other components in addition to the valve body (e.g., various valve guides to control the motion of the valve body, the valve seat, and/or one or more valve springs that tend to hold the valve closed, with the valve body reversibly sealed against the valve seat).

Each individual bore in a plunger pump housing is subject to fatigue due to alternating high and low pressures which occur with each stroke of the plunger cycle. Conventional plunger pump housings typically fail due to fatigue cracks in one of the areas defined by the intersecting suction, plunger, access and discharge bores as schematically illustrated in FIG. 3.

To reduce the likelihood of fatigue cracking in the high pressure plunger pump housings described above, a Y-block housing design has been proposed. The Y-block design, which is schematically illustrated in FIG. 4, reduces stress concentrations in a plunger pump housing such as that shown in FIG. 3 by increasing the angles of bore intersections above 90°. In the illustrated example of FIG. 4, the bore intersection angles are approximately 120°. A more complete cross-sectional view of a Y-block plunger pump fluid section is schematically illustrated in FIG. 5.

Although several variations of the Y-block design have been evaluated, none have become commercially successful for several reasons. One reason is that mechanics find field maintenance on Y-block fluid sections difficult. For example, replacement of plungers and/or plunger packing is significantly more complicated in Y-block designs than in the earlier designs represented by FIG. 1. In the earlier designs, provision is made to push the plunger distally through the plunger bore and out through an access bore (see, e.g., FIG. 3). This operation, which would leave the plunger packing easily accessible from the proximal end of the plunger bore, is impossible in a Y-block design.

Thus the Y-block configuration, while reducing stress in plunger pump housings relative to earlier designs, is associated with significant disadvantages. However, new high pressure plunger pump housings that provide both improved internal access and superior stress reduction are described in U.S. Pat. Nos. 6,623,259, 6,544,012 and 6,382,940, which are incorporated herein by reference. One embodiment of a right angular plunger pump such as that described in U.S. Pat. No. 6,623,259 (hereinafter the '259 patent) is schematically illustrated in FIG. 6. It includes a right-angular plunger pump housing comprising a suction valve bore (suction bore), discharge valve bore (discharge bore), plunger bore and access bore. The suction and discharge bores each have a portion with substantially circular cross-sections for accommodating, e.g., a valve seat. Note that the illustrated portions of the suction and discharge bores that accommodate a valve seat are slightly conical to facilitate substantially leak-proof and secure placement of each valve seat in the pump housing (e.g., by press-fitting a valve seat that has an interference fit with the pump housing). Less commonly, the portions of suction and discharge bores intended to accommodate a valve seat are cylindrical instead of being slightly conical. Further, each bore (i.e., suction, discharge, access and plunger bores) comprises a transition area which interfaces with other bore transition areas.

The plunger bore of the right-angular plunger pump housing of FIG. 6 comprises a plunger bore having a proximal packing area (i.e., an area relatively nearer the power section) and a distal transition area (i.e., an area relatively more distant from the power section). Between the packing and transition areas is a right circular cylindrical area for accommodating a plunger. The transition area of the plunger bore facilitates interfaces with analogous transition areas of other bores as noted above.

Each bore transition area of the right-angular pump housing of FIG. 6 has a stress-reducing feature comprising an elongated (e.g., elliptical or oblong) cross-section that is substantially perpendicular to each respective bore's longitudinal axis. Intersections of the bore transition areas are chamfered, the chamfers comprising additional stress-reducing features. Further, the long axis of each such elongated cross-section is substantially perpendicular to a plane that contains, or is parallel to, the longitudinal axes of the suction, discharge, access and plunger bores.

An elongated suction bore transition area, as described in the '259 patent, can simplify certain plunger pump housing structural features needed for installation of a suction valve. Specifically, the valve spring retainer of a suction valve installed in such a plunger pump housing does not require a retainer arm projecting from the housing. Nor do threads have to be cut in the housing to position the retainer that secures the suction valve seat. Benefits arising from the absence of a suction valve spring retainer arm include stress reduction in the plunger pump housing and simplified machining requirements. Further, the absence of threads associated with a suction valve seat retainer in the suction bore eliminates the stress-concentrating effects that would otherwise be associated with such threads.

Threads can be eliminated from the suction bore if the suction valve seat is inserted via the access bore and the suction bore transition area and press-fit into place as described in the '259 patent. Following this, the suction valve body can also be inserted via the access bore and the suction bore transition area. Finally, a valve spring is inserted via the access bore and the suction bore transition area and held in place by a similarly-inserted oblong suction valve spring retainer, an example of which is described in the '259 patent. Note that the '259 patent illustrates an oblong suction valve spring retainer having a guide hole (for a top-stem-guided valve body), as well as an oblong suction valve spring retainer without a guide hole (for a crow-foot-guided valve body). Both of these oblong suction valve spring retainer embodiments are secured in a pump housing of the '259 patent by clamping about an oblong lip, the lip being a structural feature of the housing (see FIG. 6 for a schematic illustration of oblong lip 266 in a right angular plunger pump housing).

The '259 patent also shows how discharge valves can be mounted in the fluid end of a high-pressure pump incorporating positive displacement pistons or plungers. For well service applications both suction and discharge valves typically incorporate a traditional full open seat design with each valve body having integral crow-foot guides. This design has been adapted for the high pressures and repetitive impact loading of the valve body and valve seat that are seen in well service. However, stem-guided valves with full open seats could also be considered for well service because they offer better flow characteristics than traditional crow-foot-guided valves. But in a full open seat configuration stem-guided valves may have guide stems on both sides of the valve body (i.e., "top" and "lower" guide stems) or only on one side of the valve body (e.g., as in top stem guided valves) to maintain proper alignment of the valve body with the valve seat during opening and closing. Conventional valve designs incorporating secure placement of guides for both top and lower valve guide stems have been associated with complex components and difficult maintenance.

The '295 application, of which the present application is a continuation-in-part, describes alternative methods and apparatus related to valve stem guide and spring retainer assemblies and to plunger pump housings in which they are used. Typically, such plunger pump housings incorporate one or more of the stress-relief structural features described herein, plus one or more additional structural features associated with use of alternative valve stem guide and spring retainer assemblies in the housings. Such plunger pump housings do not, however, comprise an oblong lip (see, e.g., structure 266 in FIG. 6 as noted above) for securing a suction valve spring retainer. The absence of this oblong lip simplifies machining of the plunger pump housing, and the corresponding design results in reduced stress within the pump housing.

Illustrated embodiments in the '295 application of valve stem guide and spring retainer assemblies include, for example, a combination comprising a discharge valve lower stem guide (DVLSG), plus a suction valve top stem guide and spring retainer (SVTSG-SR), plus spacers for spacing the DVLSG a predetermined distance apart from the SVTSG-SR. Alternative embodiments comprise other combinations of structural features such as, for example, spring retainers and spacers with or without associated valve guides. Note that due to the close fit of the DVLSG within the discharge bore and of the SVTSG-SR within the suction bore, insertion or removal of these structures requires maintaining precise alignment as to rotation and angle of entry with their respective bores. Such precise alignment may be difficult to maintain during field service operations.

SUMMARY OF THE INVENTION

The present invention includes improved valve guide and spring retainer assemblies for use in plunger pump housings having an outwardly flared transition area in the suction bore. Alternative valve guide and spring retainer assemblies of the present invention are for use in plunger pump housings having an outwardly flared transition area in the discharge bore as well as the suction bore. Note that an outwardly flared transition area in the suction bore (together with an outwardly flared transition area in the discharge bore in alternative embodiments) allows relatively easier insertion and removal of portions of improved valve guides and spring retainer assemblies in these areas.

When intended for use in a plunger pump housing having an outwardly flared transition area in both the suction and discharge bores (together with a suction valve having a top guide stem and a discharge valve having a top guide stem and a lower guide stem), an embodiment of an improved valve guide and spring retainer assembly of the present invention comprises a tapered suction valve top stem guide and spring retainer (hereinafter an SVTSG-SR-II), as well as a tapered discharge valve lower stem guide (hereinafter DVLSG-II), together with at least one side spacer. In such an embodiment, each side spacer contacts the DVLSG-II (along a discharge lateral alignment lip) and the SVTSG-SR-II (along an opposing suction lateral alignment lip) to transmit the suction valve spring force acting on the SVTSG-SR-II to a shoulder in the discharge bore. The DVLSG-II simultaneously acts as a guide for the discharge valve lower guide stem.

To transmit the suction valve spring force as described above, the side spacer(s) must be free to move laterally (i.e., vertical movement toward the discharge bore as shown in the illustrated embodiments) during installation of opposing suction and discharge valves in a pump housing. Such lateral side spacer movement ends on contact of the DVLSG-II with the discharge bore shoulder; this contact being maintained thereafter by the compressive force of the suction valve spring as transmitted to the DVLSG-II via the side spacer(s). During lateral side spacer movement, longitudinal movement of each side spacer is limited by the access bore plug on one end of the spacer and by a plunger bore shoulder on the opposite end. To permit the required free lateral side spacer movement, sufficient longitudinal clearance is provided for each side spacer during installation of opposing suction and discharge valves in the pump housing to prevent the side spacer ends from binding on either the access bore plug or the plunger bore shoulder. Note that each side spacer may comprise at least one insertion ramp to ease its insertion between a DVLSG-II and an opposing SVTSG-SR-II (i.e., along a discharge lateral alignment lip and an opposing suction lateral alignment lip).

In an alternative embodiment of an improved valve guide and spring retainer assembly of the present invention intended for use in a plunger pump housing having an outwardly flared transition area in both the suction and discharge bores (together with a suction valve having a top guide stem and a discharge valve having a top guide stem but no lower guide stem), the DVLSG-II may be replaced with a tapered discharge bore spacer (hereinafter a TDBS), which functions with at least one side spacer to transmit the suction valve spring force acting on the SVTSG-SR-II to a shoulder in the discharge bore. Provision is made for lateral spacer movement and longitudinal spacer clearance during installation of opposing suction and discharge valves as described above.

When intended for use in a plunger pump housing having an outwardly flared transition area only in the suction bore (together with a suction valve having a top guide stem and a discharge valve having a top guide stem but no lower guide stem), an alternative embodiment of the improved valve guide and spring retainer assembly of the present invention comprises an SVTSG-SR-II together with a side spacer-plug. A side spacer plug comprises a flanged access bore plug having at least one integral side spacer. In such an embodiment, the side spacer(s) function to transmit the spring force of the SVTSG-SR-II to a shoulder in the access bore via the flanged access bore plug (with which the side spacer(s) are integral). The access bore plug flange is maintained in contact with the access bore shoulder by an access bore plug retainer. Note that in this embodiment each side spacer has a first edge for insertion along one suction lateral alignment lip. Additionally, no side spacer experiences significant longitudinal or lateral movement when transmitting the suction valve spring force to the access bore shoulder. Thus there is no need for a plunger bore shoulder to limit longitudinal side spacer movement. Further, each side spacer first edge may comprise an insertion ramp to ease insertion along a suction lateral alignment lip.

Field maintenance is facilitated for pumps incorporating the plunger pump housings and improved valve guide and spring retainer assemblies of the present invention. Specifically, the requirement for maintaining precise alignment as to rotation and angle of entry during insertion and removal of the DVLSG-II, the TDBS and/or the SVTSG-SR-II is relaxed. Additionally, one or more O-rings on an SVTSG-SR-II, a DVLSG-II or a TDBS can assist in retaining these structures temporarily in their respective outwardly flared bore transition areas during pump assembly. And O-rings on an SVTSG-SR-II have a self-centering function that makes the use of top-stem-guided suction valves more efficient and practical.

As described herein, the present invention comprises improved valve guide and spring retainer assemblies for use with suction valves having top guide stems. These suction valves may additionally have lower guide stems, though such valves are relatively difficult to maintain because access to the lower suction valve stem guide usually requires removal of the suction manifold. On the other hand, access to suction valve top stem guides and discharge valve lower stem guides may be achieved via the access bore as described herein. And access to a discharge valve top stem guide may typically be achieved simply by removing a discharge bore plug retainer and discharge bore plug.

Plunger pump housings of the present invention comprise substantially right-angular housings having substantially in-line (i.e., opposing) suction and discharge bores, plus substantially in-line (i.e., opposing) plunger and access bores, plus high pressure seals, retainers, etc. not otherwise called out. Where indicated as being colinear and/or coplanar, bore centerlines (or longitudinal axes) may vary somewhat from these precise conditions, due for example to manufacturing tolerances, while still substantially reflecting advantageous structural features of the present invention. The occurrence of such variations in certain manufacturing practices means that plunger pump housing embodiments of the present invention may vary somewhat from a precise right-angular configuration. Such plunger pump housings substantially reflect advantageous structural features of the present invention notwithstanding angles between the centerlines or longitudinal axes of adjacent bores that are within a range from approximately 85 degrees to approximately 95 degrees. Where the lines and/or axes forming the sides of such an angle to be measured are not precisely coplanar, the angle measurement is conveniently approximated using projections of the indicated lines and/or axes on a single plane in which the projected angle to be approximated is maximized.

In illustrated plunger pump housings of the present invention the suction bore transition area is outwardly flared as described above, while the discharge bore transition area may or may not be outwardly flared. One illustrated embodiment of a plunger pump housing of the present invention comprises a suction bore comprising a first portion having substantially circular cross-sections and a first centerline for accommodating, e.g., a circular suction valve seat, followed by a second portion having elongated cross-sections. The suction bore second portion comprises in general a cylindrical area having elongated cross-sections followed by an outwardly flared transition area having elongated cross-sections. The cylindrical area is not flared and may have zero length (i.e., the cylindrical area may be eliminated) in alternative embodiments, while the outwardly flared transition area has a first predetermined outward taper that facilitates insertion, removal and self-centering of a SVTSG-SR-II. There is a suction bore shoulder between the first and second portions of the suction bore.

One illustrated embodiment of a plunger pump housing of the present invention also comprises a discharge bore comprising a first portion with substantially circular cross-sections and a second centerline for accommodating, e.g., a circular discharge valve seat, followed by a second portion. A discharge bore shoulder is located between the first and second portions. The discharge bore second portion comprises, in general, a cylindrical area (i.e., an area that is not flared) extending from the discharge bore shoulder and having elongated cross-sections, followed by an outwardly flared transition area having elongated cross-sections. The cylindrical area may have zero length (i.e., may be eliminated) in alternative embodiments, while the outwardly flared transition area has a second predetermined outward taper that facilitates insertion, removal and self-centering of a DVLSG-II or a TDBS). Note that the first and second centerlines are colinear.

An alternative illustrated embodiment of a plunger pump housing of the present invention comprises a discharge bore comprising a portion with substantially circular cross-sections and a second centerline for accommodating, e.g., a circular discharge valve seat, followed by a transition area that is not necessarily outwardly flared. Note that the first and second centerlines are colinear, and that a discharge bore shoulder may be either present or absent. If the discharge bore shoulder is absent in this embodiment, stress in the pump housing is thereby reduced.

All illustrated embodiments of a plunger pump housing of the present invention comprise a plunger bore comprising a proximal packing area and a distal transition area, the packing area having substantially circular cross-sections and a third centerline. The third centerline is coplanar with the first and second centerlines. An alternative illustrated embodiment of a plunger pump housing of the present invention comprises, in addition to these features, a plunger bore shoulder between the proximal plunger bore packing area and the distal plunger bore transition area.

Illustrated embodiments of plunger pump housings of the present invention further comprise an access bore comprising a distal retainer portion with substantially circular cross-sections and a fourth center line. The distal retainer portion accommodates an access bore plug retainer and is followed by a proximal transition area having elongated cross-sections that can be sealed with a removable (flanged or flangeless) access bore plug. An access bore shoulder is located between the distal retainer portion and the proximal transition area. Removal of the access bore plug facilitates access to interior portions of the plunger pump housing. The access bore proximal transition area may be cylindrical or, in alternative embodiments, it may be inwardly flared (i.e., the proximal transition area may have a first predetermined inward taper extending from the access bore shoulder). Removal and replacement of an access bore plug having a peripheral inward taper corresponding to the first predetermined inward taper of such an access bore transition area is easier than performing these operations with a cylindrical access bore plug in a cylindrical access bore transition area. However, maintenance of precise alignment as to rotation and angle of entry or removal of such a cylindrical access bore plug can still be achieved during routine maintenance because of the relatively exposed location of the access bore plug. Thus, the choice of a cylindrical or tapered configuration for an access bore plug and a corresponding access bore transition area may additionally involve considerations such as the cost of machining these structures. Note that as further described below, one illustrated embodiment of a flanged access bore side spacer-plug has an integral flange (which bears on the access bore shoulder) and at least one integral side spacer, whereas an alternative illustrated embodiment of a flangeless access bore plug has neither an integral flange nor an integral side spacer. The access bore's fourth centerline is colinear with the third centerline.

Schematic illustrations of plunger pump housings of the present invention show that the suction bore transition area and the suction bore cylindrical area (when present) each have at least one elongated cross-section substantially perpendicular to the first centerline and with a long axis substantially perpendicular to a plane containing the first, second, third and fourth centerlines.

Analogously, schematic illustrations of plunger pump housings of the present invention show that the discharge bore transition area and the discharge bore cylindrical area (when present) each have at least one elongated cross-section substantially perpendicular to the second centerline and with a long axis substantially perpendicular to a plane containing the first, second, third and fourth centerlines.

The plunger bore transition area of schematically illustrated plunger pump housings of the present invention also has at least one elongated cross-section substantially perpendicular to the third centerline. Such an elongated cross-section has a long axis substantially perpendicular to a plane containing the first, second, third and fourth centerlines.

And the access bore transition area of schematically illustrated plunger pump housings of the present invention has at least one elongated cross-section substantially perpendicular to the fourth centerline. Such an elongated cross-section has a long axis substantially perpendicular to a plane containing the first, second, third and fourth centerlines. Note that each said bore transition area has at least one adjacent chamfer for smoothing bore interfaces.

An illustrated embodiment of a DVLSG-II of the present invention can be placed substantially within a correspondingly outwardly flared discharge bore transition area of a plunger pump housing of the present invention. The illustrated DVLSG-II comprises a body having a first end, a second end, a longitudinal axis, and at least one elongated cross-section that is perpendicular to the longitudinal axis. The DVLSG-II's body is outwardly flared longitudinally (i.e., the body has a third predetermined peripheral outward taper from the first end to the second end). The DVLSG-II's body additionally comprises at least one peripheral O-ring groove, a centrally-located lower valve stem guide, and at least one longitudinal fluid passage extending between the first and second ends. The first end of the DVLSG-II body comprises a shoulder mating surface for mating with a corresponding shoulder within the discharge bore, and the second end of the DVLSG-II body comprises at least one discharge lateral alignment lip. An O-ring lies in the O-ring groove.

For applications of the present invention involving a discharge valve body comprising a top guide stem without a lower guide stem, the lower stem guide of the DVLSG-II may be eliminated, thus forming a tapered discharge bore spacer (TDBS). In such applications, a TDBS can be placed substantially within a correspondingly outwardly flared discharge bore transition area of a plunger pump housing. The TDBS comprises a body having a first end, a second end, a longitudinal axis, and at least one elongated cross-section that is perpendicular to the longitudinal axis. The TDBS's body is outwardly flared longitudinally (i.e., the body has a fourth predetermined peripheral outward taper from the first end to the second end). The TDBS's body additionally comprises at least one peripheral O-ring groove and at least one longitudinal fluid passage extending between the first and second ends. The first end of the TDBS body comprises a shoulder mating surface for mating with a corresponding shoulder within the discharge bore. The second end of the TDBS body comprises at least one discharge lateral alignment lip. An O-ring lies in the O-ring groove.

Alternative embodiments of an improved valve stem guide and spring retainer assembly of the present invention comprise, in addition to a DVLSG-II or TDBS, an SVTSG-SR-II for placement substantially opposite the DVLSG-II or TDBS and within a correspondingly outwardly flared suction bore transition area of a plunger pump housing of the present invention. The SVTSG-SR-II comprises a body having a first end, a second end, a longitudinal axis, and at least one elongated cross-section that is perpendicular to the longitudinal axis. The SVTSG-SR-II body additionally comprises at least one peripheral O-ring groove, a centrally-located upper valve stem guide, and at least one longitudinal fluid passage extending between the first and second ends. For applications involving a suction valve without an upper valve stem, the upper valve stem guide may be eliminated from the SVTSG-SR-II, thus forming a suction valve spring retainer (SVSR). An O-ring lies in the O-ring groove, and the body of the SVTSG-SR-II (or SVSR) is outwardly flared longitudinally (i.e., the body has a fifth predetermined peripheral outward taper from the first end to the second end). The SVTSG-SR-II second end comprises at least one suction lateral alignment lip.

Alternative embodiments of valve stem guide and spring retainer assemblies of the present invention further comprise, in addition to either a DVLSG-II or a TDBS, plus an SVTSG-SR-II or an SVSR, at least one side spacer having first and second parallel edges for insertion along one discharge lateral alignment lip and an opposing suction lateral alignment lip. The first and second parallel edges are spaced apart sufficiently to assure that, upon insertion of at least one side spacer as described between a DVLSG-II (or TDBS) and an SVTSG-SR-II (or SVSR) in a corresponding plunger pump housing, the DVLSG-II (or TDBS) and the SVTSG-SR-II (or SVSR) will be self-centered. Further, the shoulder mating surface of the DVLSG-II (or TDBS) will contact a discharge bore shoulder to transmit the suction valve spring force from the SVTSG-SR-II (or SVSR) to the shoulder.

Simultaneous with this transmission of suction valve spring force, self-centering of the DVLSG-II (or the TDBS) and the SVTSG-SR-II (or SVSR) will occur. Such self-centering is facilitated by one or more O-rings in peripheral O-ring grooves. These O-rings and grooves are dimensioned to allow an increasingly close sliding fit as the DVLSG-II (or the TDBS) and the SVTSG-SR-II (or SVSR) are accommodated within their respective outwardly flared transition areas. Such accommodation is achieved when, for example, the first predetermined outward taper of the suction bore transition area is equal to or slightly greater than the fifth predetermined peripheral outward taper of the SVTSG-SR-II (or SVSR). Similarly, such accommodation is achieved when, for example, the second predetermined outward taper of the discharge bore transition area is equal to or slightly greater than the third predetermined peripheral outward taper of the DVLSG-SR or the fourth predetermined peripheral outward taper of the TDBS. As the O-rings contact the respective outwardly flared transition areas, further insertion is resisted due to increasing compression of the O-rings. Because such O-ring compression occurs substantially equally along each O-ring periphery, the resulting peripheral compressive forces tend to self-center the DVLSG-II (or the TDBS), as well as the SVTSG-SR-II (or SVSR) within their respective outwardly flared transition areas. Because of the resilience of the O-rings, this self-centering function is effective over a small range of longitudinal, lateral and angular movement within each outwardly flared transition area. Thus, the DVLSG-II (or the TDBS) and the SVTSG-SR-II (or SVSR) can move slightly to accommodate small misalignments of the discharge and suction valve bodies and/or small misalignments of valve guide stems (due, e.g., to manufacturing tolerances). Note also that each side spacer may be dimensioned to fit closely between the plunger pump housing and a plunger inserted for use within the housing. By decreasing the amount of internal pump space that is not swept by the plunger, such close fitting of each side spacer can improve a pump's volumetric efficiency.

Illustrated embodiments of the valve stem guide and spring retainer assemblies of the present invention include two suction lateral alignment lips, two discharge lateral alignment lips, and two side spacers. The illustrations further show that the two side spacers may be integral to a flanged access bore cover plug or, in alternative embodiments, one or both side spacers may be unattached to a flangeless access bore cover plug.

Alternative embodiments of the present invention are disclosed below with reference to appropriate drawings.

BRIEF DESCRIPTION OF THE DRAWINGS

FIG. 14A schematically illustrates an end view of a flangeless access bore plug and separate spacers, each spacer having an insertion ramp.

FIG. 14B schematically illustrates the sectional view labeled B-B in FIG. 14A.

FIG. 14C schematically illustrates a top view of the flangeless access bore plug and separate spacers in FIG. 14A.

FIG. 17A schematically illustrates an end view of a flangeless access bore plug and separate spacers.

FIG. 17B schematically illustrates the sectional view labeled B-B in FIG. 17A.

FIG. 17C schematically illustrates a top view of the flangeless access bore plug and separate spacers in FIG. 17A.

DETAILED DESCRIPTION OF PREFERRED EMBODIMENTS

Figure 1:
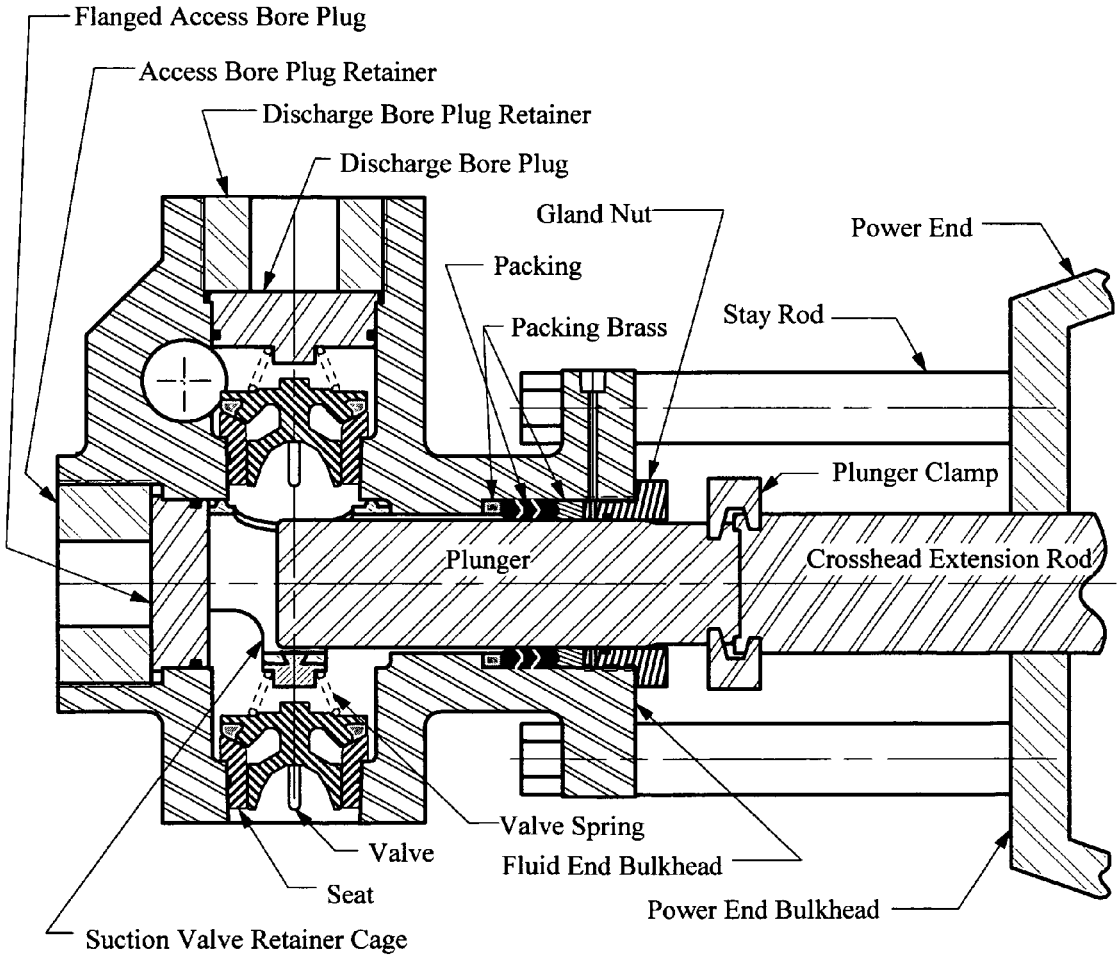
FIG. 1 is a cross-sectional schematic view of a typical plunger pump fluid section showing its connection to a power section by stay rods.
Figure 2:
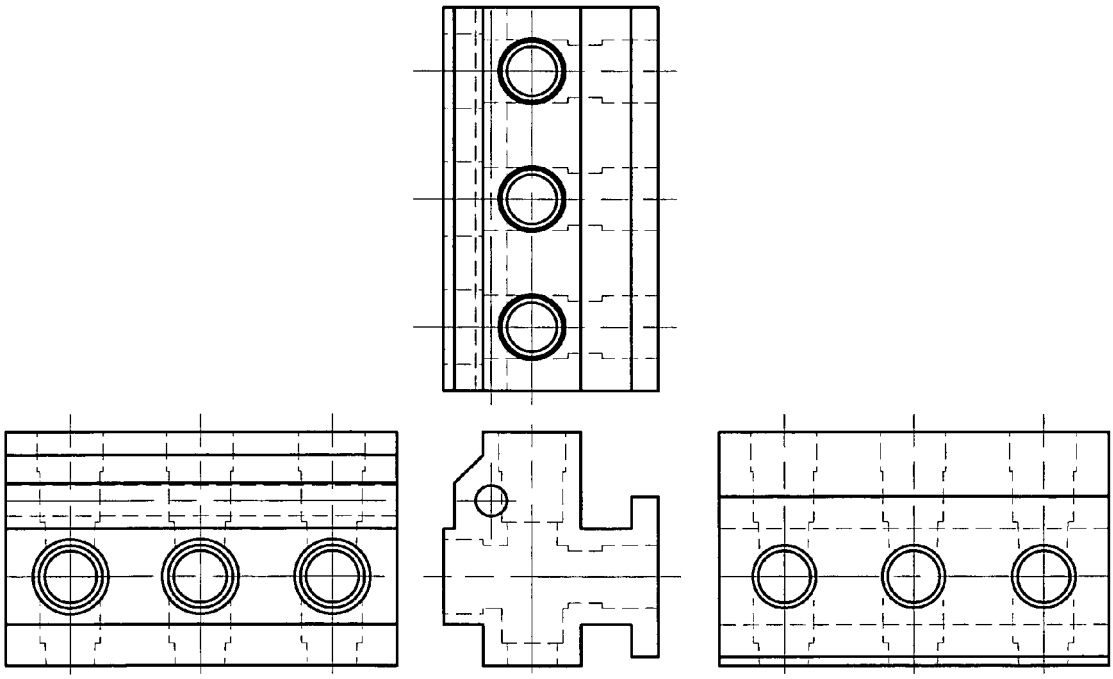
FIG. 2 schematically illustrates a conventional Triplex plunger pump fluid section housing.
Figure 3:
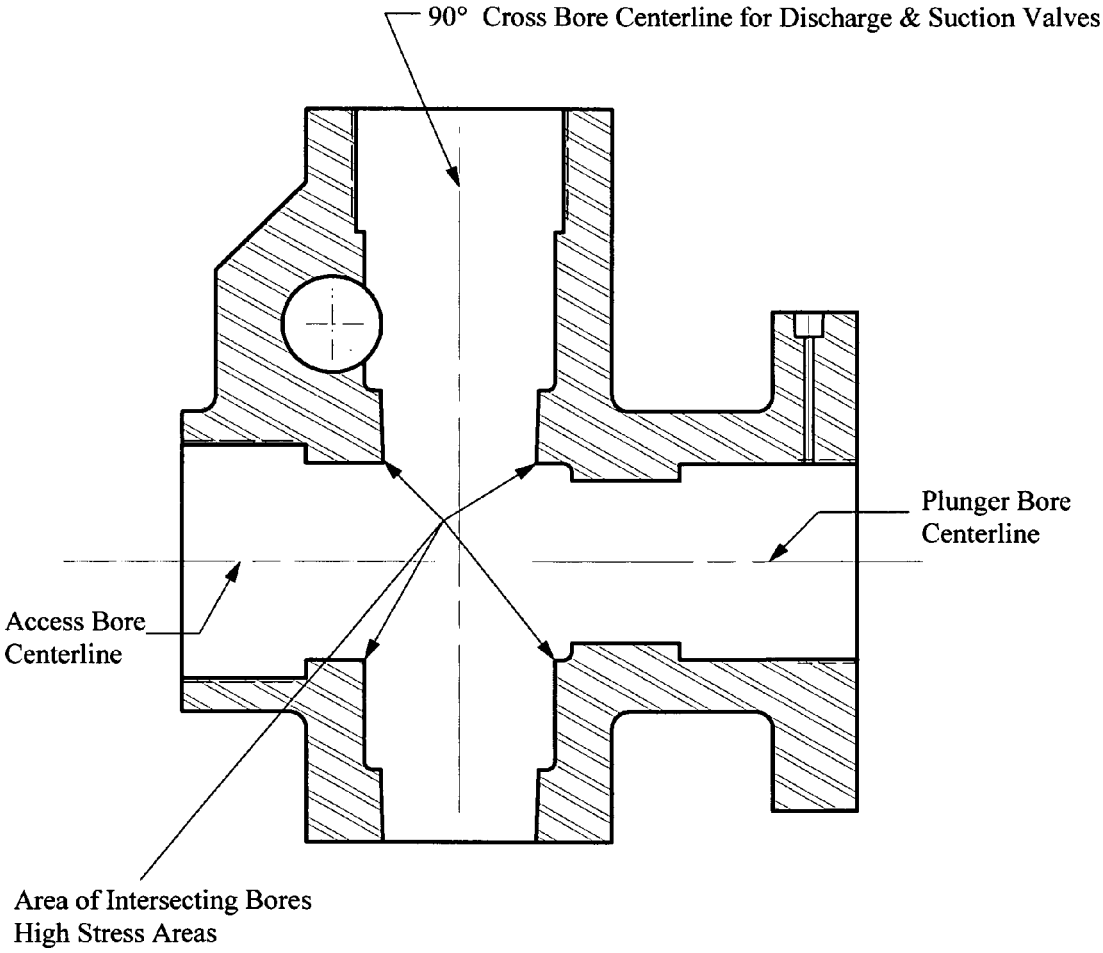
FIG. 3 is a cross-sectional schematic view of suction, plunger, access and discharge bores of a conventional plunger pump housing intersecting at right angles and showing areas of elevated stress.
Figure 4:
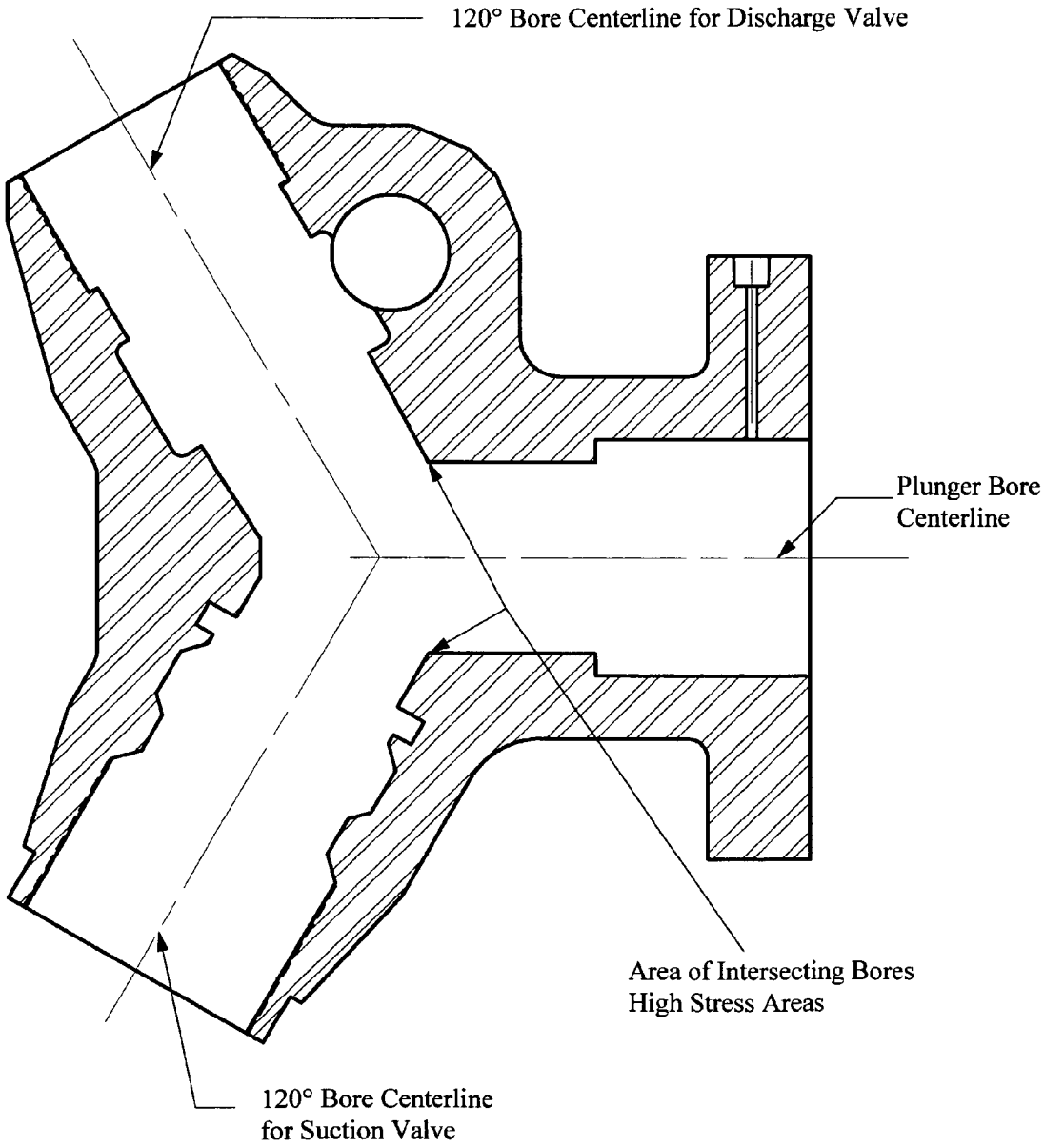
FIG. 4 is a cross-sectional schematic view of suction, plunger and discharge bores of a Y-block plunger pump housing intersecting at obtuse angles showing areas of elevated stress.
Figure 5:
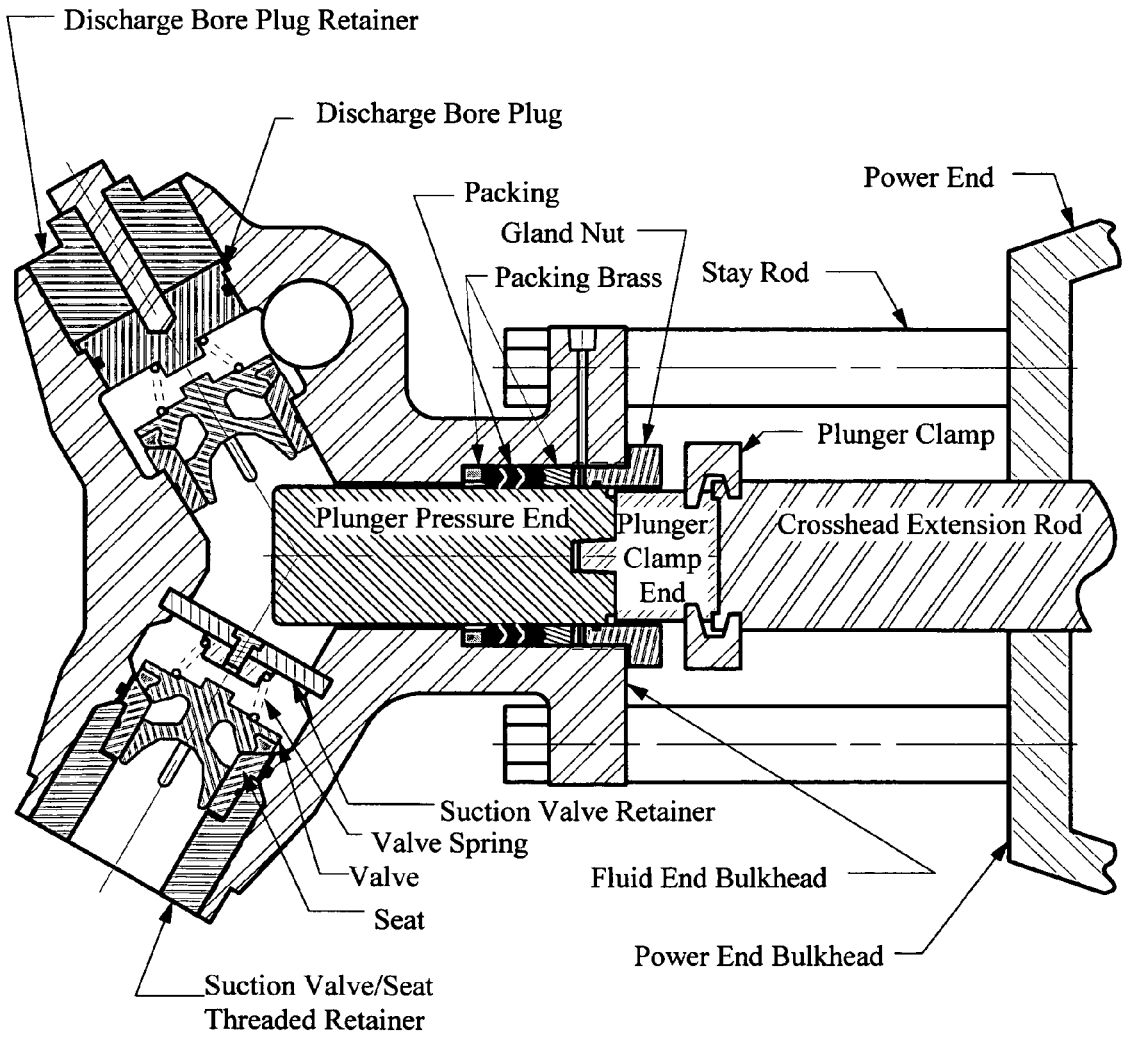
FIG. 5 is a cross-sectional schematic view similar to that in FIG. 4, including internal plunger pump components of a Y-block fluid section.
Figure 6:
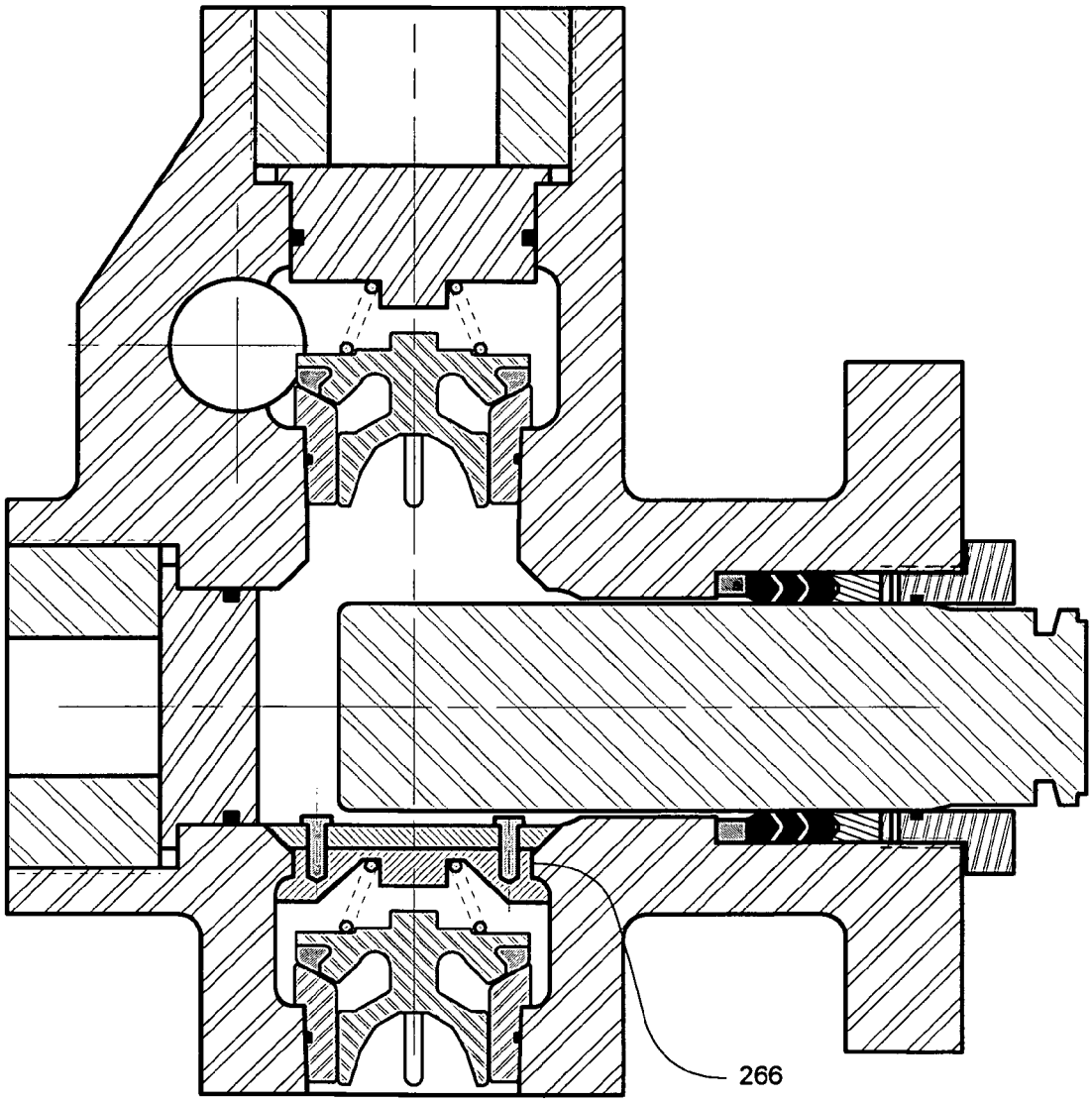
FIG. 6 schematically illustrates a cross-section of a right-angular plunger pump with valves, plunger, and a suction valve spring retainer clamped about a lip of the housing.
Figure 7A:
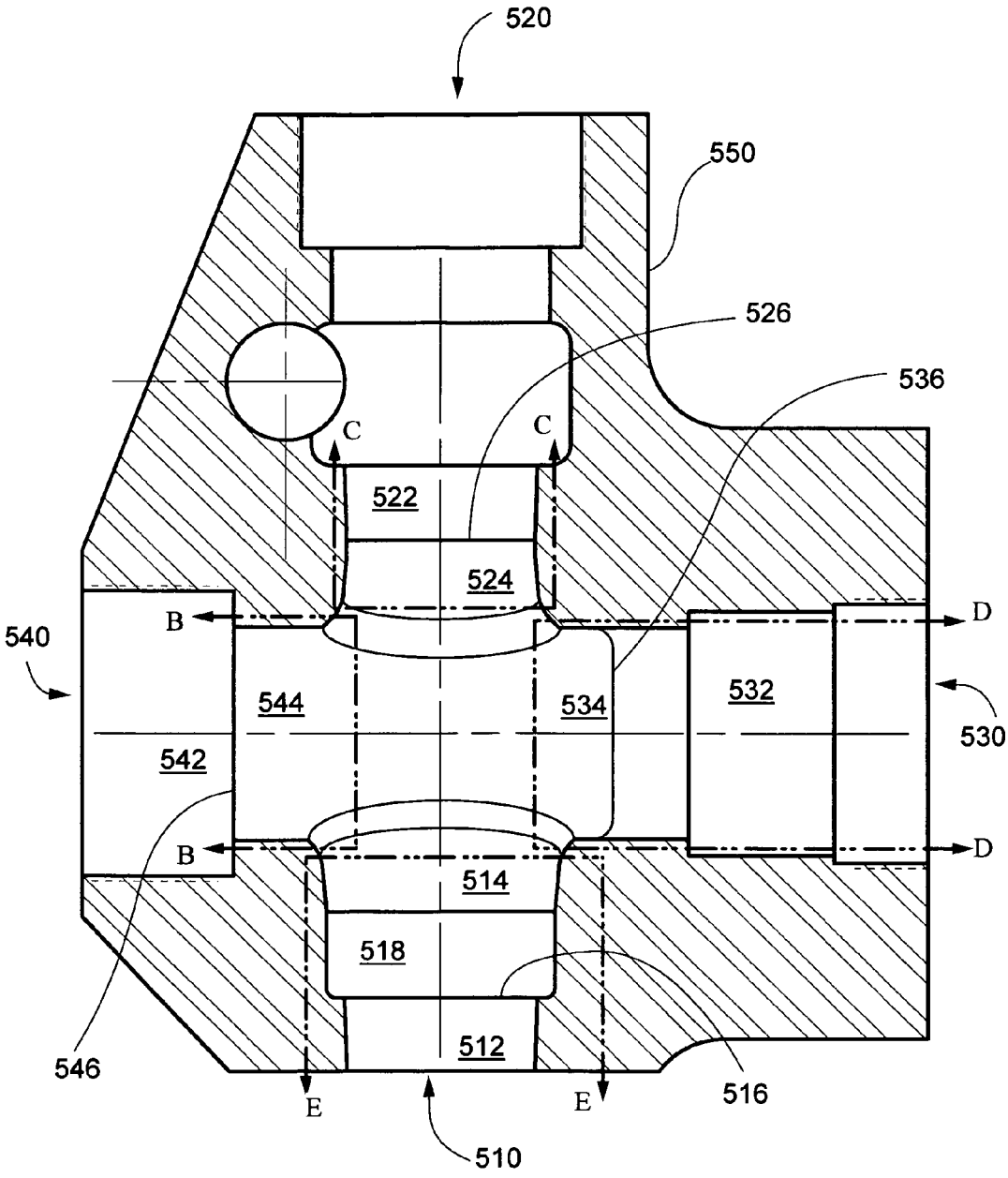
FIG. 7A schematically illustrates a cross-section of a right-angular plunger pump housing having outwardly flared transition areas in the suction and discharge bores.
Figure 7B:
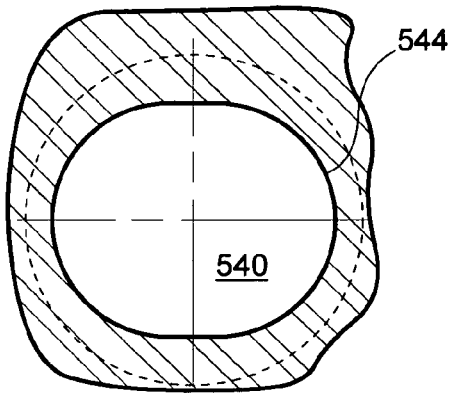
FIG. 7B schematically illustrates the sectional view labeled B-B in FIG. 7A FIG. 7C schematically illustrates the sectional view labeled C-C in FIG. 7A.
Figure 7C:
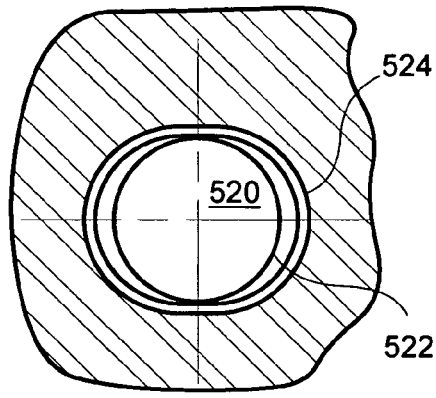
FIG. 7D schematically illustrates the sectional view labeled D-D in FIG. 7A.
FIG. 7E schematically illustrates the sectional view labeled E-E in FIG. 7A.
Figure 7D:
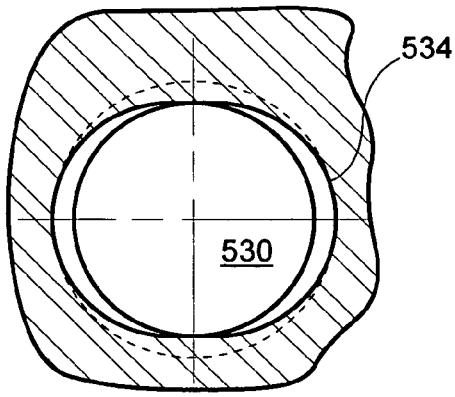
Figure 7E:
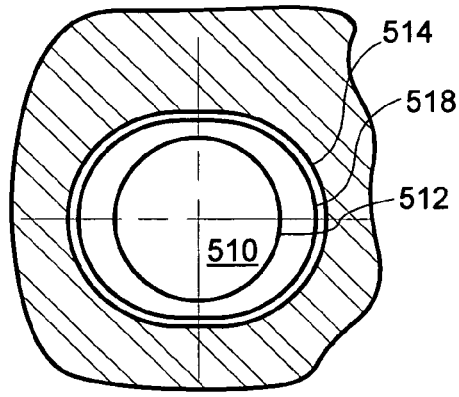

FIG. 7A schematically illustrates cross-sections of a right-angular pump housing 550 of the present invention, including a suction bore 510 having a first centerline and comprising a first portion 512 with substantially circular cross-sections followed a second portion. The second portion of suction bore 510 comprises a cylindrical area 518 followed by an outwardly flared transition area 514. There is a suction bore shoulder 516 between first portion 512 and cylindrical area 518.

Continuing with FIG. 7A, a discharge bore 520 comprises a first portion 522 with substantially circular cross-sections, a second portion comprising an outwardly flared transition area 524, a discharge bore shoulder 526 between the first and second portions, and a second centerline, the first and second centerlines being colinear.

Continuing with FIG. 7A, a plunger bore 530 comprises a proximal packing area 532 having substantially circular cross-sections, a distal transition area 534, a plunger bore shoulder 536 between packing area 532 and transition area 534, and a third centerline. The third centerline is coplanar with the first and second centerlines.

Continuing with FIG. 7A, an access bore 540 comprises a proximal cylindrical transition area 544, a distal retainer area 542 with circular cross-sections, a shoulder 546 between transition area 544 and retainer area 542, and a fourth center line. The fourth centerline is colinear with the third center line. Note that each bore transition area in pump housing 550 has at least one adjacent chamfer to provide additional stress relief.

FIGS. 7B, 7C, 7D and 7E schematically illustrate the indicated partial cross-sections of access bore 540, discharge bore 520, plunger bore 530, and suction bore 510 in FIG. 7A respectively. Suction bore outwardly flared transition area 514 and cylindrical area 518 each have at least one elongated cross-section substantially perpendicular to the first centerline and with a long axis substantially perpendicular to a plane containing the first, second, third and fourth centerlines. Discharge bore outwardly flared transition area 524 has at least one elongated cross-section substantially perpendicular to the second centerline and with a long axis substantially perpendicular to a plane containing the first, second, third and fourth centerlines. Plunger bore transition area 534 has at least one elongated cross-section substantially perpendicular to the third centerline and with a long axis substantially perpendicular to a plane containing the first, second, third and fourth centerlines. Access bore transition area 544 has at least one elongated cross-section substantially perpendicular to the fourth centerline and with a long axis substantially perpendicular to a plane containing the first, second, third and fourth centerlines.

Figure 8A:
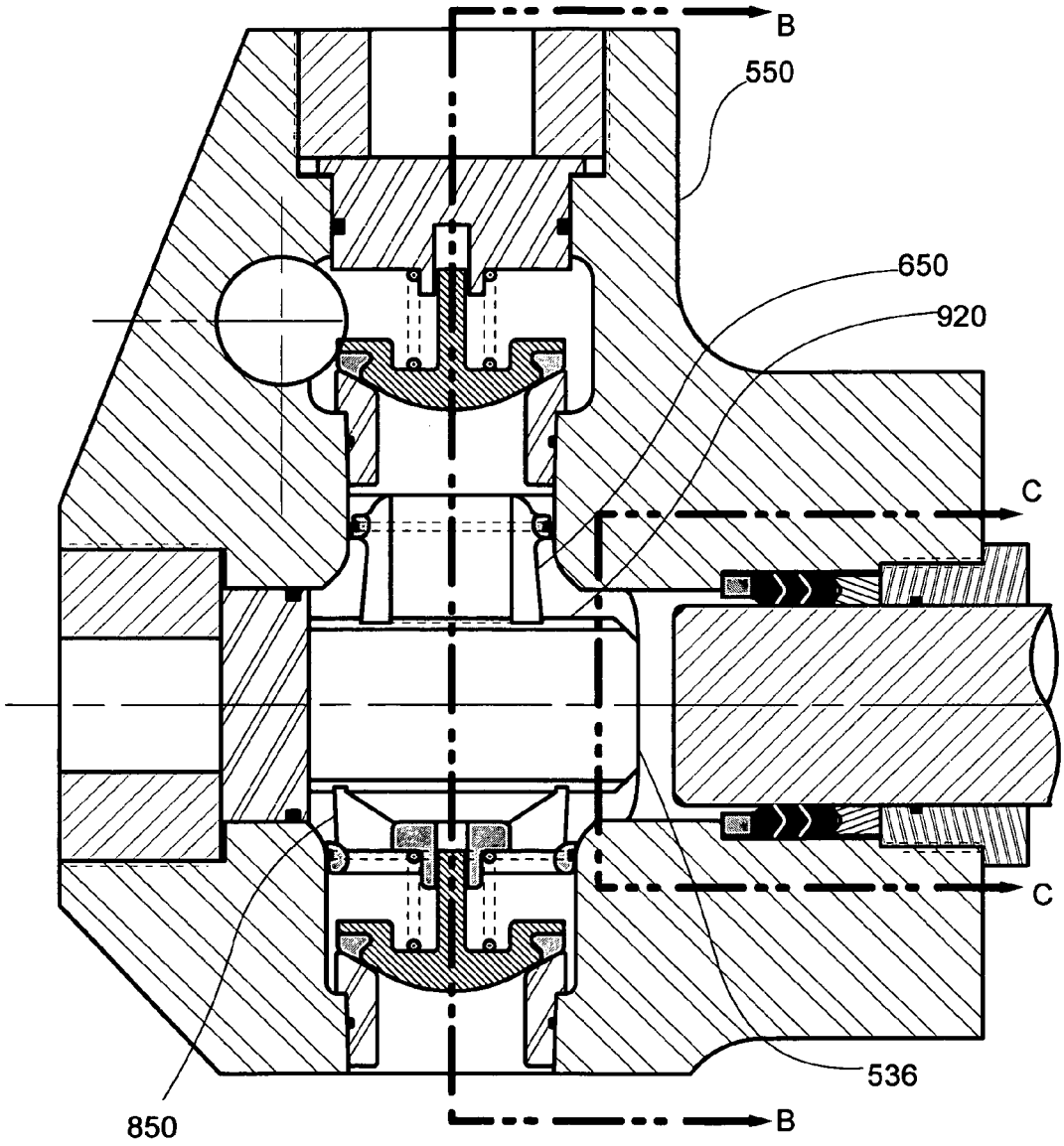
FIG. 8A schematically illustrates a cross-section of a right-angular plunger pump having outwardly flared transition areas in the suction and discharge bores, a top stem guided suction valve, a top stem guided discharge valve, and a flangeless access bore plug.
Figure 8B:
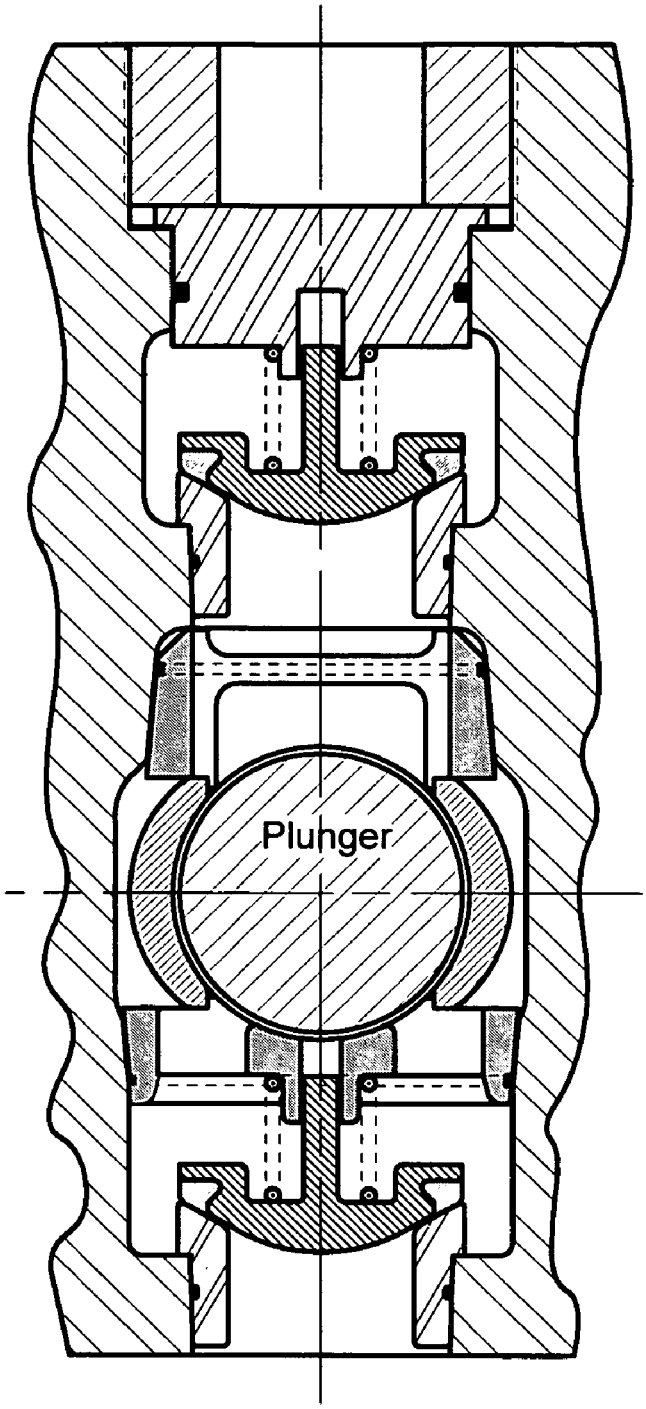
FIG. 8B schematically illustrates the sectional view labeled B-B in FIG. 8A.
Figure 8C:
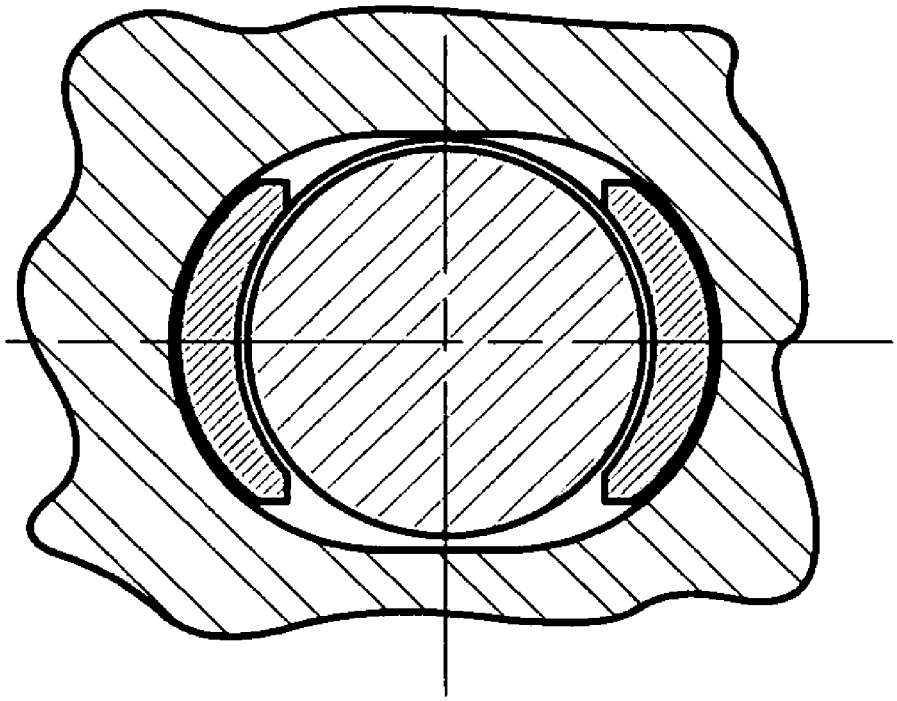
FIG. 8C schematically illustrates the sectional view labeled C-C in FIG. 8A.

An embodiment of a valve stem guide and spring retainer assembly within a pump housing 550 is schematically illustrated in FIGS. 8A-C. Components of the assembly are shown in greater detail in FIGS. 11A-C, 13A-D, and 17A-C. The assembly comprises a tapered discharge bore spacer 650 (see FIGS. 13A-D) which itself comprises a body 652 having a first end 654, a second end 656, a longitudinal axis, and at least one elongated cross-section perpendicular to the longitudinal axis. First end 654 comprises a shoulder mating surface 658, and second end 656 comprises at least one discharge lateral alignment lip 660. Body 652 is outwardly flared longitudinally and additionally comprises at least one peripheral O-ring groove 662, and at least one longitudinal fluid passage 664 extending between first end 654 and second end 656. An O-ring 663 lies in O-ring groove 662.

The embodiment of a valve stem guide and spring retainer assembly within a pump housing 550 as schematically illustrated in FIGS. 8A-C further comprises a tapered suction valve top stem guide and spring retainer 850 (see FIGS. 11A-C) comprising a body 852 having a first end 854, a second end 856, a longitudinal axis, and at least one elongated cross-section perpendicular to the longitudinal axis. Second end 856 comprises at least one suction lateral alignment lip 860. Body 852 is outwardly flared longitudinally and additionally comprises at least one peripheral O-ring groove 862. At least one longitudinal fluid passage 864 extends between first end 854 and second end 856. An O-ring 863 lies in O-ring groove 862.

The embodiment of a valve stem guide and spring retainer assembly within a pump housing 550 as schematically illustrated in FIGS. 8A-C further comprises at least one side spacer 920 (see FIGS. 17A-C) having first and second parallel edges 922 and 924 respectively for insertion along one discharge lateral alignment lip 660 and an opposing suction lateral alignment lip 860. Longitudinal movement of each side spacer 920 is limited by flangeless access bore plug 940 and plunger bore shoulder 536.

An alternative embodiment of a side spacer 920' is schematically illustrated in FIGS. 14A-C. In this alternative embodiment, each said side spacer 920' having first and second parallel edges 922' and 924' additionally comprises an insertion ramp 926 on at least one said parallel edge. During assembly of a plunger pump incorporating at least one side spacer 920', each insertion ramp 926 makes contact with a suction lateral alignment lip or a discharge lateral alignment lip. Due to the relatively acute angle (i.e., less than about 45 degrees) that insertion ramp 926 makes with the parallel edge 922' or 924', each insertion ramp 926 confers the mechanical advantage of an inclined plane in moving a tapered suction valve top stem guide and spring retainer 850 or a tapered discharge bore spacer 650 further into their respective suction or discharge bores.

Figure 9A:
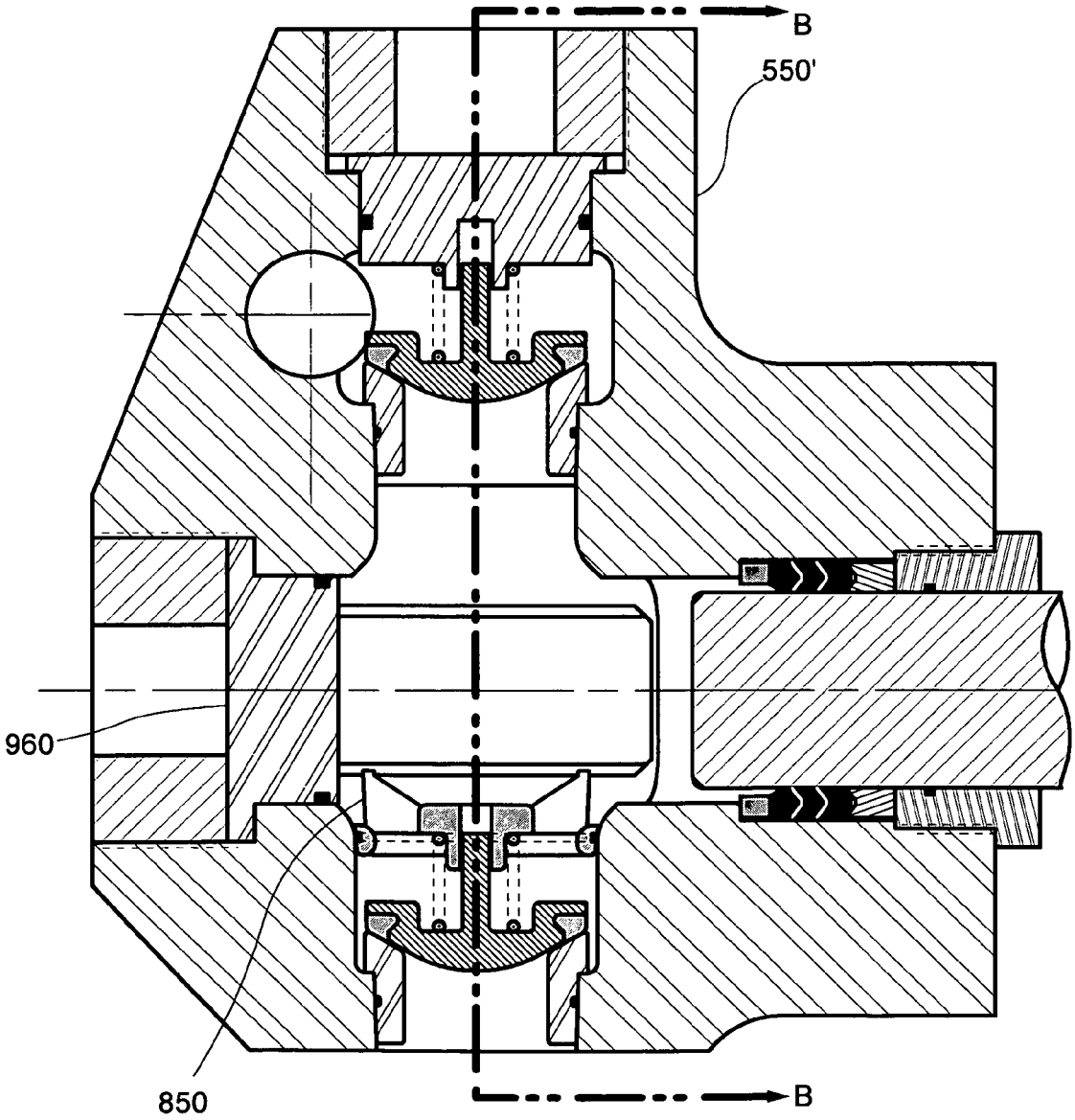
FIG. 9A schematically illustrates a cross-section of a right-angular plunger pump having an outwardly flared transition area in the suction bore, a cylindrical discharge bore transition area, a top stem guided suction valve, a top stem guided discharge valve, and a flanged access bore side spacer-plug.
Figure 9B:
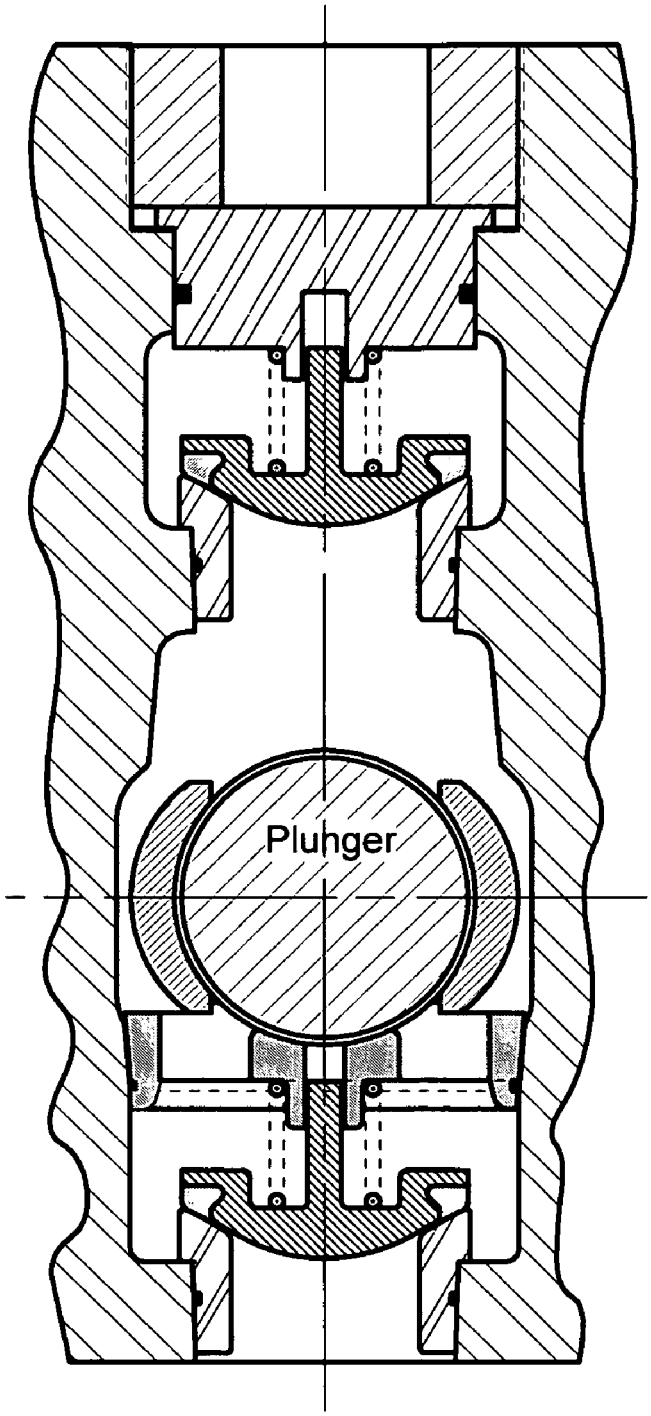
FIG. 9B schematically illustrates the sectional view labeled B-B in FIG. 9A.

A first alternative embodiment of a valve stem guide and spring retainer assembly within a pump housing 550' is schematically illustrated in FIGS. 9A-B. Components of the assembly are shown in greater detail in FIGS. 11A-C and 15A-C. Note that while neither a tapered discharge valve lower stem guide nor a tapered discharge bore spacer is included in this alternative embodiment, a tapered suction valve top stem guide and spring retainer 850 (see FIGS. 11A-C) is included.

Also included in the first alternative embodiment is a side spacer-plug 960 (see FIGS. 15A-C) comprising a flanged access bore plug 950 integral with at least one side spacer 930. Each side spacer 930 has a first edge 932 for insertion along a suction lateral alignment lip 860. Longitudinal and lateral movement of each side spacer 930 is limited by flanged access bore plug 950, with which it is integral.

Figure 16C:
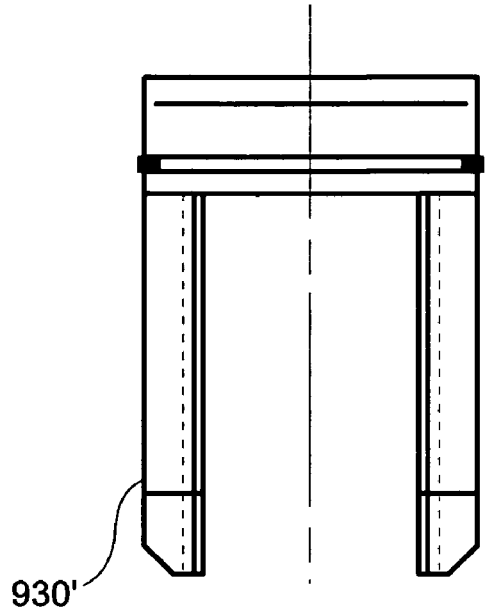
FIG. 16C schematically illustrates a top view of the flanged access bore plug and integral spacers in FIG. 16A.
Figure 16B:
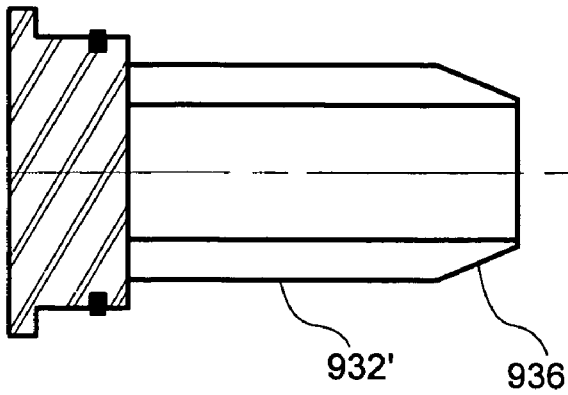
FIG. 16B schematically illustrates the sectional view labeled B-B in FIG. 16A.
Figure 16A:
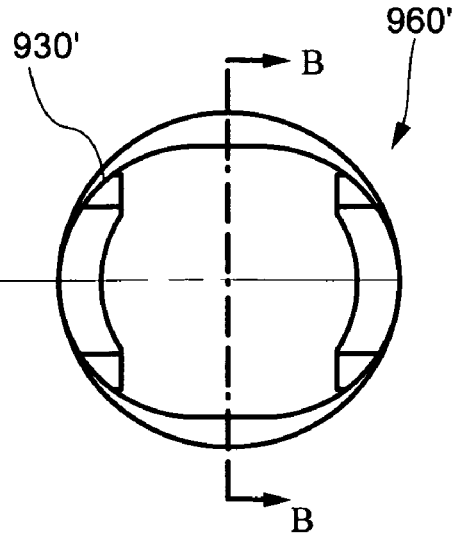
FIG. 16A schematically illustrates an end view of a flanged access bore plug and integral spacers, each spacer having an insertion ramp.

A further alternative to the first alternative embodiment comprises a side spacer-plug 960' that is schematically illustrated in FIGS. 16A-C. In this further alternative embodiment, each side spacer 930' has a first edge 932' that additionally comprises an insertion ramp 936. During assembly of a plunger pump incorporating a side spacer-plug 960', each insertion ramp 936 makes contact with a suction lateral alignment lip. Due to the relatively acute angle (i.e., less than about 45 degrees) that insertion ramp 936 makes with the edge 932', each insertion ramp 936 confers the mechanical advantage of an inclined plane in moving a tapered suction valve top stem guide and spring retainer 850 further into the suction bore.

Figure 10A:
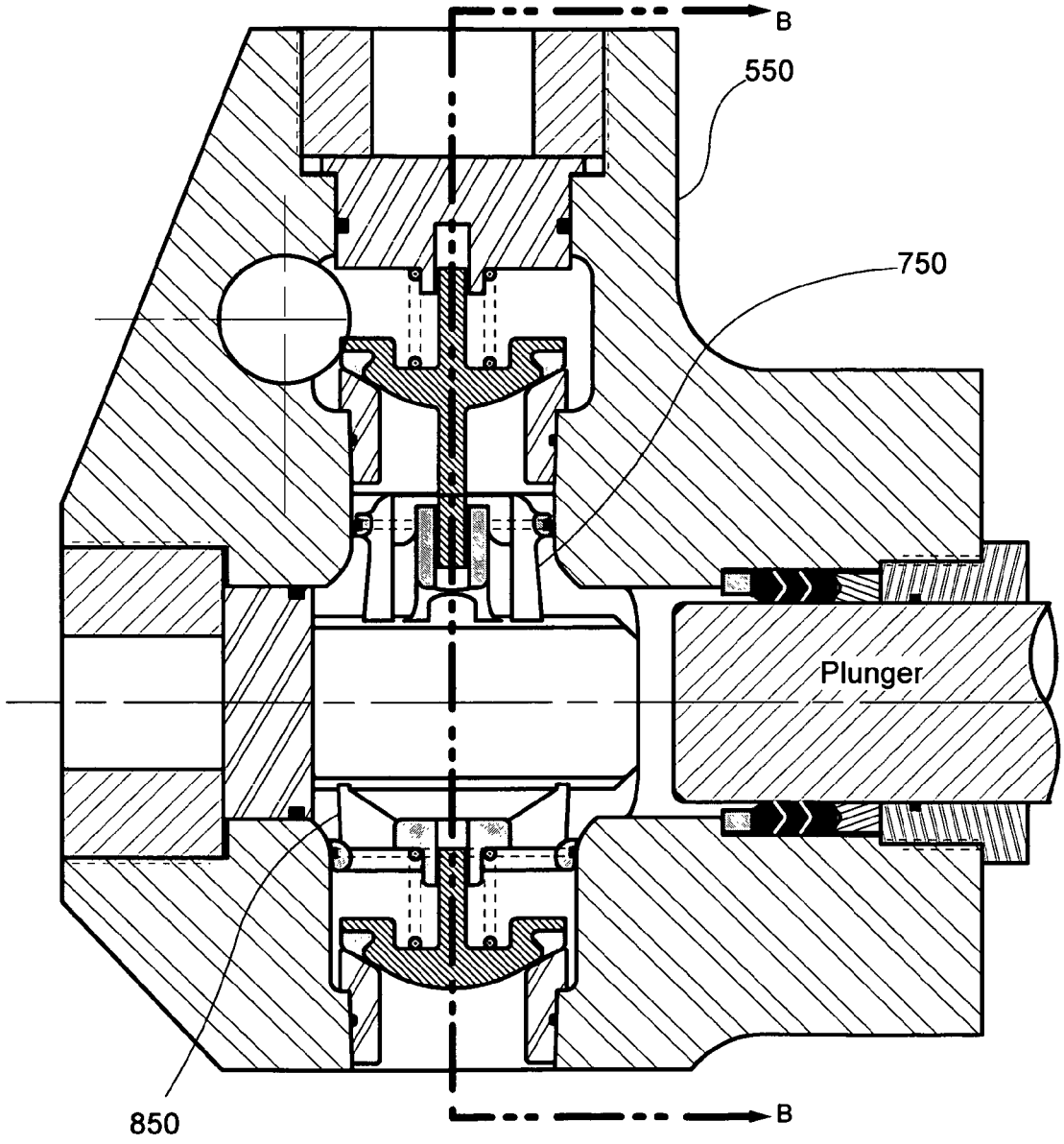
FIG. 10A schematically illustrates a cross-section of a right-angular plunger pump having outwardly flared transition areas in the suction and discharge bores, a top stem guided suction valve, a discharge valve with top and lower guide stems, and a flangeless access bore plug.
Figure 10B:
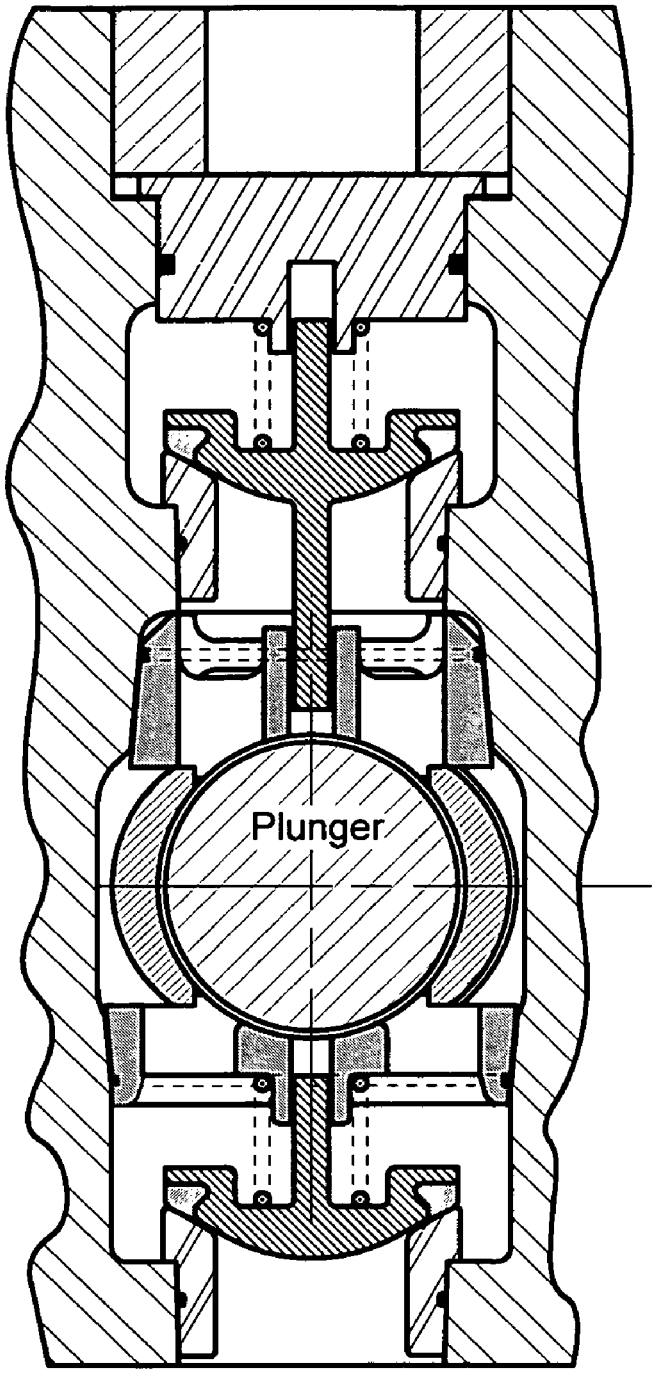
FIG. 10B schematically illustrates the sectional view labeled B-B in FIG. 10A.
Figure 11A:
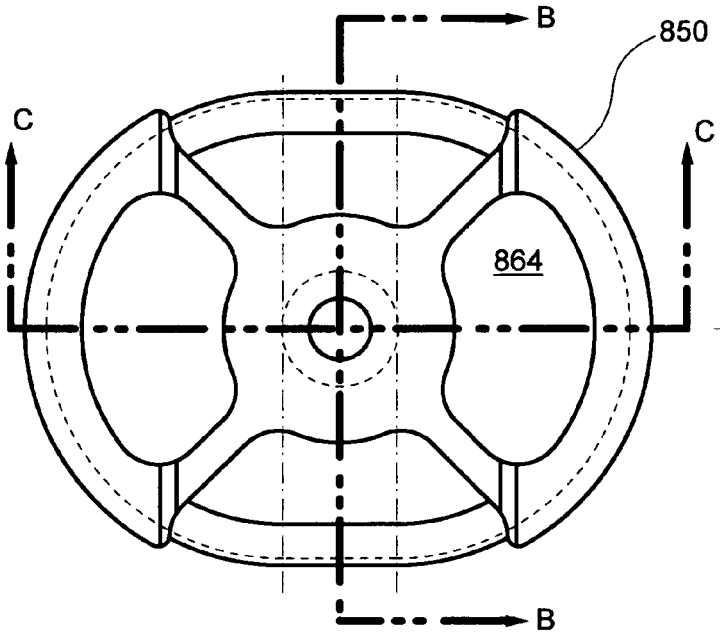
FIG. 11A schematically illustrates a top view of an SVTSG-SR-II.
Figure 11B:
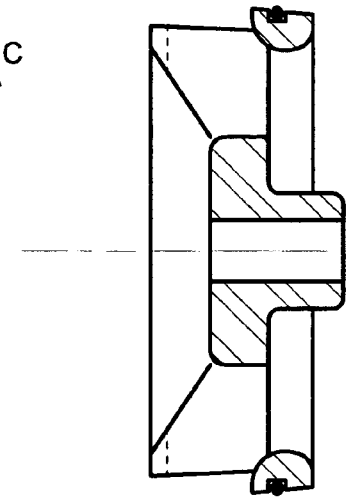
FIG. 11B schematically illustrates the sectional view labeled B-B in FIG. 11A.
Figure 11C:
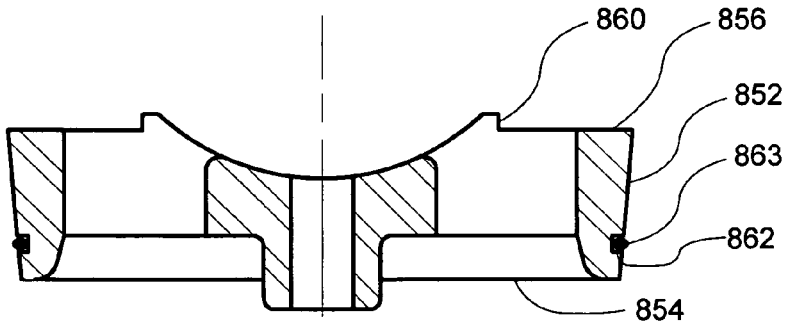
FIG. 11C schematically illustrates the sectional view labeled C-C in FIG. 11A.
Figure 12A:
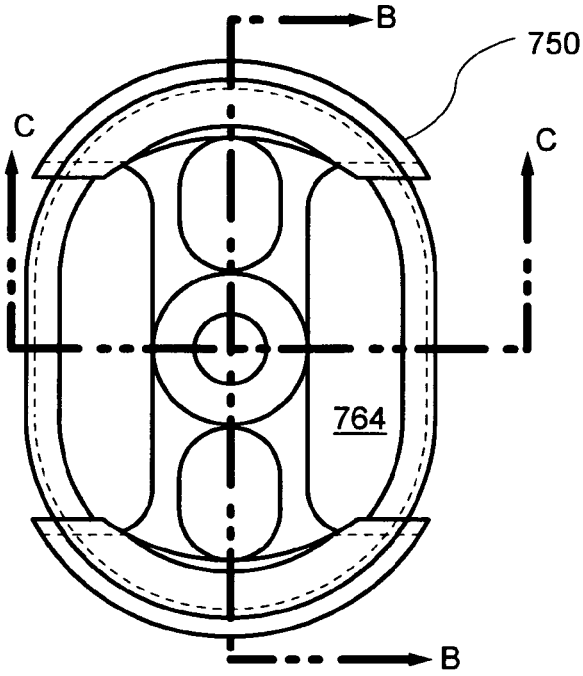
FIG. 12A schematically illustrates a top view of an DVLSG-II.
Figure 12B:
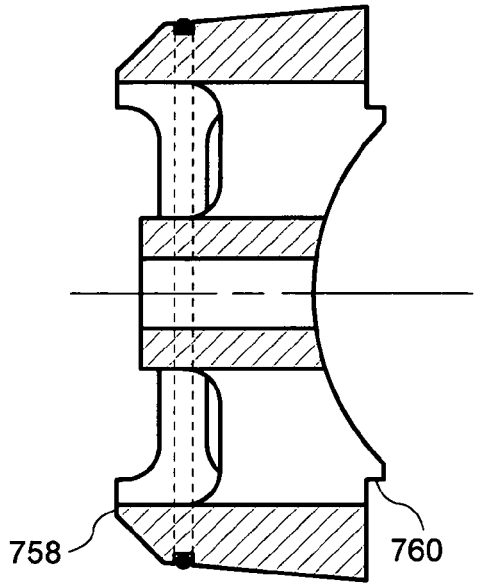
FIG. 12B schematically illustrates the sectional view labeled B-B in FIG. 12A.
Figure 12C:
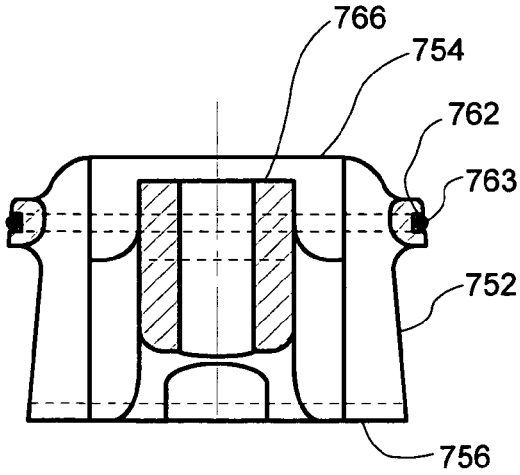
FIG. 12C schematically illustrates the sectional view labeled C-C in FIG. 12A.
Figure 12D:
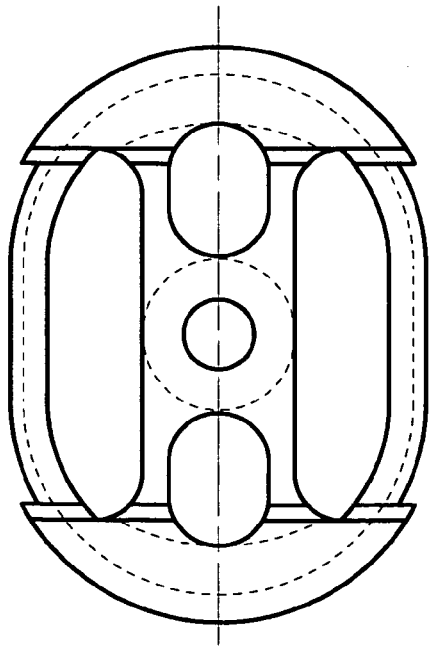
FIG. 12D schematically illustrates a bottom view of an DVLSG-II.
Figure 13A:
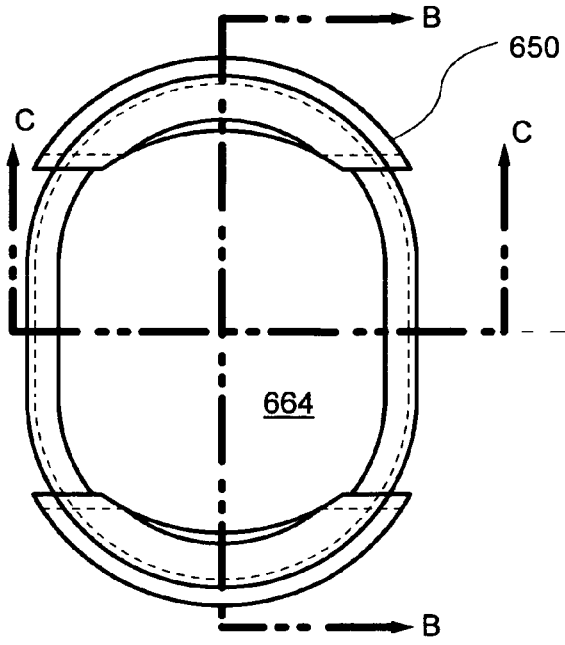
FIG. 13A schematically illustrates a top view of a TDBS.
Figure 13B:
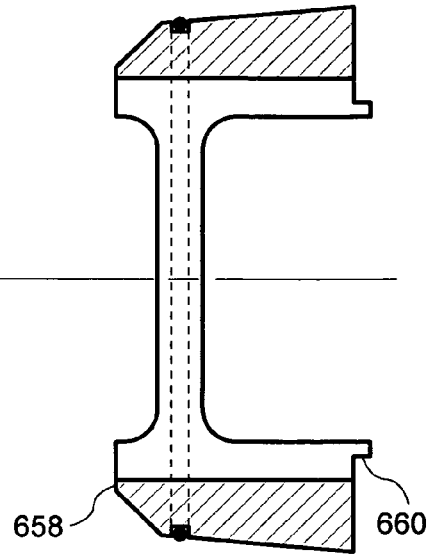
FIG. 13B schematically illustrates the sectional view labeled B-B in FIG. 13A.
Figure 13C:
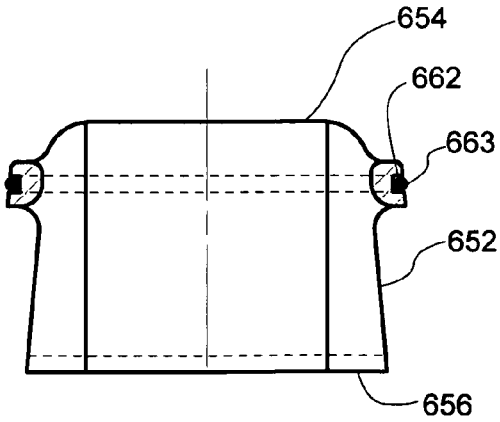
FIG. 13C schematically illustrates the sectional view labeled C-C in FIG. 13A.
Figure 13D:
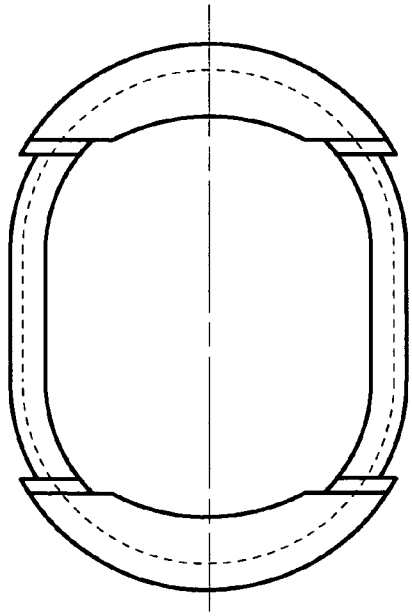
FIG. 13D schematically illustrates a bottom view of a TDBS.
Figure 15C:
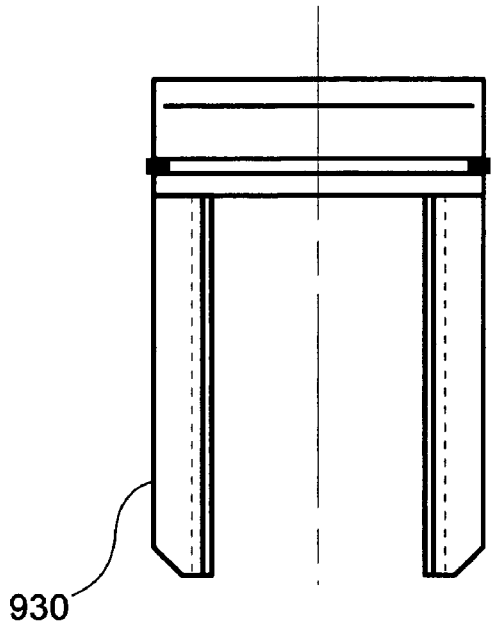
FIG. 15C schematically illustrates a top view of the flanged access bore plug and integral spacers in FIG. 15A.
Figure 15B:
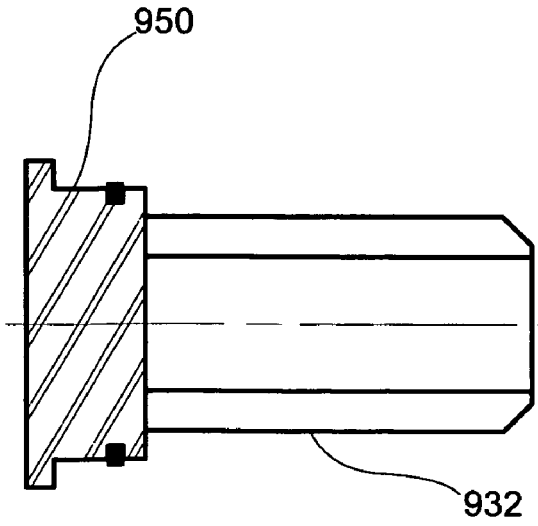
FIG. 15B schematically illustrates the sectional view labeled B-B in FIG. 15A.
Figure 15A:
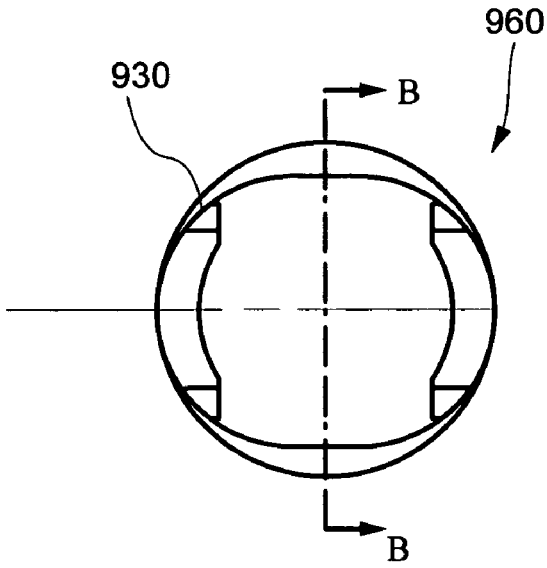
FIG. 15A schematically illustrates an end vies of a flanged access bore plug and integral spacers.

A second alternative embodiment of a valve stem guide and spring retainer assembly within a pump housing 550 is schematically illustrated in FIGS. 10A-B. Components of the assembly are shown in greater detail in FIGS. 11A-C, 12A-D, and 17A-C. The assembly comprises a tapered discharge valve lower stem guide 750 (see FIGS. 12A-D) which itself comprises a body 752 having a first end 754, a second end 756, a longitudinal axis, and at least one elongated cross-section perpendicular to the longitudinal axis. First end 754 comprises a shoulder mating surface 758, and second end 756 comprises at least one discharge lateral alignment lip 760. Body 752 is outwardly flared longitudinally and additionally comprises at least one peripheral O-ring groove 762, a centrally-located valve stem guide 766, and at least one longitudinal fluid passage 764 extending between first end 754 and second end 756. An O-ring 763 lies in O-ring groove 762.

The second alternative embodiment of a valve stem guide and spring retainer assembly within a pump housing 550 as schematically illustrated in FIGS. 10A-B further comprises a tapered suction valve top stem guide and spring retainer 850 as described above (see FIGS. 11A-C, and at least one side spacer 920 as described above (see FIGS. 17A-C).

What is claimed is:

1. A plunger pump housing comprising:

a suction bore comprising a first portion with substantially circular cross-sections, a second portion comprising a cylindrical area followed by an outwardly flared transition area, a suction bore shoulder between said first and second portions, and a first centerline;

a discharge bore comprising a first portion with substantially circular cross-sections, a second portion comprising a transition area, and a second centerline, said first and second centerlines being colinear;

a plunger bore comprising a proximal packing area and a distal transition area, said packing area having substantially circular cross-sections and a third centerline, said third centerline being coplanar with said first and second centerlines; and an access bore comprising a distal retainer portion with circular cross-sections, a proximal transition area, an access bore shoulder between said proximal transition area and said distal retainer portion, and a fourth center line, said fourth centerline being colinear with said third center line;

wherein said suction bore outwardly flared transition area and said suction bore cylindrical area each have at least one elongated cross-section substantially perpendicular to said first centerline and with a long axis substantially perpendicular to a plane containing said first, second, third and fourth centerlines;

wherein said discharge bore transition area has at least one elongated cross-section substantially perpendicular to said second centerline and with a long axis substantially perpendicular to a plane containing said first, second, third and fourth centerlines;

wherein said plunger bore transition area has at least one elongated cross-section substantially perpendicular to said third centerline and with a long axis substantially perpendicular to a plane containing said first, second, third and fourth centerlines; and wherein said access bore proximal transition area has at least one elongated cross-section substantially perpendicular to said fourth centerline and with a long axis substantially perpendicular to a plane containing said first, second, third and fourth centerlines.

2. The pump housing of claim 1 wherein said discharge bore transition area is outwardly flared.

3. The pump housing of claim 2 wherein said discharge bore additionally comprises a discharge bore shoulder between said first portion and said second portion.

4. The pump housing of claim 1 wherein said discharge bore transition area is cylindrical.

5. The pump housing of claim 1 wherein said plunger bore additionally comprises a plunger bore shoulder between said proximal packing area and said distal transition area.

6. The pump housing of claim 1 wherein said access bore transition area is inwardly flared.

* * * * *